US010968502B2

(12) United States Patent
Sun

(10) Patent No.: US 10,968,502 B2
(45) Date of Patent: Apr. 6, 2021

(54) METHOD OF MANUFACTURE OF MULTIPHASE, COLD-ROLLED ULTRA-HIGH STRENGTH STEEL

(71) Applicant: NUCOR CORPORATION, Charlotte, NC (US)

(72) Inventor: Weiping Sun, Huger, SC (US)

(73) Assignee: NUCOR CORPORATION, Charlotte, NC (US)

( * ) Notice: Subject to any disclaimer, the term of this patent is extended or adjusted under 35 U.S.C. 154(b) by 316 days.

(21) Appl. No.: 15/803,295

(22) Filed: Nov. 3, 2017

(65) Prior Publication Data

US 2018/0127855 A1 May 10, 2018

Related U.S. Application Data

(60) Provisional application No. 62/417,683, filed on Nov. 4, 2016.

(51) Int. Cl.

| | |
|---|---|
| ***C22C 38/04*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |

(Continued)

(52) U.S. Cl.

CPC ..... *C22C 38/04* (2013.01); *C21D 8/0236* (2013.01); *C22C 38/001* (2013.01); *C22C 38/02* (2013.01); *C22C 38/06* (2013.01); *C22C 38/12* (2013.01); *C22C 38/16* (2013.01); *C23C 2/06* (2013.01); *C23C 2/40* (2013.01); *C21D 2211/002* (2013.01); *C21D 2211/005* (2013.01); *C21D 2211/008* (2013.01)

(58) Field of Classification Search

CPC ..... C21D 2211/002; C21D 2211/005; C21D 2211/008; C21D 8/0236; C22C 38/04; C22C 38/12; C22C 38/16; C23C 2/40

USPC ..... 148/337

See application file for complete search history.

(56) References Cited

U.S. PATENT DOCUMENTS 3,988,173 A 10/1976 Kawano
3,988,174 A 10/1976 Kawano (Continued)

FOREIGN PATENT DOCUMENTS

WO 20150039763 A2 3/2015

OTHER PUBLICATIONS

The International Bureau of WIPO; International Preliminary Report on Patentability dated May 16, 2019, 14 Pages.

(Continued)

*Primary Examiner* — Jie Yang

(74) *Attorney, Agent, or Firm* — Christopher J. Knors; Moore & Van Allen PLLC

(57) ABSTRACT

A cold-rolled ultra-high strength, multi-phase structured steel is disclosed with improved stamping and forming performance during manufacturing processes, while possessing one or more of the following properties: excellent castability and rollability, excellent galvanizability and/or coatability, excellent formability, excellent fracture resistance, excellent stretch formability and stretch flangeability, excellent dent resistance, excellent durability, excellent impact performance and structural performance, excellent intrusion and crash resistance, and excellent weldability, without the purposeful addition of boron.

5 Claims, 17 Drawing Sheets

(51) Int. Cl.

| | |
|---|---|
| ***C22C 38/12*** | (2006.01) |
| ***C22C 38/16*** | (2006.01) |
| ***C23C 2/06*** | (2006.01) |
| ***C23C 2/40*** | (2006.01) |

(56) References Cited

U.S. PATENT DOCUMENTS

| | | | | |
|---|---|---|---|---|
| 6,410,163 | B1 | 6/2002 | Suzuki et al. | |
| 7,442,268 | B2 | 10/2008 | Sun | |
| 7,540,993 | B2 | 6/2009 | Reinhold et al. | |
| 7,578,894 | B2 | 8/2009 | Reinhold et al. | |
| 7,879,160 | B2 | 2/2011 | Sun | |
| 7,959,747 | B2 | 6/2011 | Sun | |
| 8,337,643 | B2 | 12/2012 | Sun | |
| 8,366,844 | B2 | 2/2013 | Sun | |
| 8,460,481 | B2 | 6/2013 | Azuma et al. | |
| 8,657,970 | B2 | 2/2014 | Yoshinaga et al. | |
| 8,733,144 | B2 | 5/2014 | Pohl et al. | |
| 8,888,933 | B2 | 11/2014 | Hayashi et al. | |
| 8,999,085 | B2 | 4/2015 | Kim et al. | |
| 9,109,275 | B2 | 8/2015 | Morimoto et al. | |
| 9,157,138 | B2 * | 10/2015 | Sun | C21D 6/005 |
| 9,194,015 | B2 | 11/2015 | Ikeda et al. | |
| 9,593,399 | B2 | 3/2017 | Jamwal et al. | |
| 2004/0035500 | A1 | 2/2004 | Ikeda et al. | |
| 2004/0060623 | A1 | 4/2004 | Boke et al. | |
| 2006/0108035 | A1 | 5/2006 | Sun | |
| 2008/0289726 | A1 | 11/2008 | Sun | |
| 2009/0071574 | A1 | 3/2009 | Sun | |
| 2009/0071575 | A1 | 3/2009 | Sun | |
| 2009/0242085 | A1 | 10/2009 | Ikeda et al. | |
| 2010/0132849 | A1 | 6/2010 | Takagi et al. | |
| 2012/0018059 | A1 | 1/2012 | Sun | |
| 2012/0222781 | A1 | 9/2012 | Azuma et al. | |
| 2012/0304448 | A1 | 12/2012 | Hartmann et al. | |
| 2012/0305144 | A1 | 12/2012 | Okamoto et al. | |
| 2013/0273392 | A1 * | 10/2013 | Nonaka | C23C 2/06 428/659 |
| 2014/0166163 | A1 | 6/2014 | Jamwal et al. | |
| 2014/0209217 | A1 | 7/2014 | Nakagaito et al. | |
| 2014/0234657 | A1 | 8/2014 | Azuma et al. | |
| 2014/0242415 | A1 | 8/2014 | Azuma et al. | |
| 2014/0311631 | A1 | 10/2014 | Hayashi et al. | |
| 2014/0342183 | A1 | 11/2014 | Wakabayashi et al. | |
| 2015/0079420 | A1 | 3/2015 | Hanlon et al. | |
| 2015/0266519 | A1 | 9/2015 | Kim et al. | |
| 2015/0329950 | A1 * | 11/2015 | Azuma | C22C 38/38 148/533 |
| 2015/0344996 | A1 * | 12/2015 | Kawano | C22C 38/02 420/110 |
| 2016/0289809 | A1 | 10/2016 | Hanlon et al. | |
| 2018/0127857 | A1 * | 5/2018 | Sun | C22C 38/06 |

OTHER PUBLICATIONS

WIPO; Written Opinion and International Search Report for International Application No. PCT/US17/59956 dated Feb. 19, 2018, 17 pages.

European Patent Office; European Patent Application No. 17868049.2; Extended European Search Report dated Mar. 26, 2020; 8 pages.

* cited by examiner

METHOD OF MANUFACTURE OF MULTIPHASE, COLD-ROLLED ULTRA-HIGH STRENGTH STEEL

CROSS-REFERENCE TO RELATED APPLICATION

This application is related to U.S. provisional application No. 62/417,683, filed Nov. 4, 2016, the content therewith being incorporated herein by reference in its entirety, and the benefit of the filing date of the provisional application is hereby claimed for all purposes that are legally served by such claim for the benefit of the filing date.

TECHNICAL FIELD

The present disclosure relates to a complex metallographic structured or multi-phase steel, cold-rolled steel, optionally coated with a metal alloy.

BACKGROUND

With ever-increasing pressure on the automotive and other industries for energy savings and emission reduction while improving product performance and cost competitiveness, more parts such as automotive parts are being manufactured using high strength steel. Some high strength steels enable use of thinner sheet to reduce the product weight, which improves vehicle fuel efficiency. Further, it is desired to improve vehicle durability, crashworthiness, intrusion resistance and impact performance to protect a driver and passengers upon collision.

Certain industries, including the automotive industry, are utilizing advanced high strength steel, or "AHSS," including dual phase steels and transformation induced plasticity, or TRIP steels. AHSS steels may meet certain strength and weight targets while using existing manufacturing infrastructure. These steels appear promising for applications requiring high press-forming and draw-forming properties to form parts with complex shapes.

However, problems related to the stamping, forming and drawing of prior AHSS steels are well known, and significant hurdles exist for successful implementation using the existing manufacturing infrastructure. Prior AHSS steels exhibited wear of tooling during cold-drawing and/or shear fracture, edge fracture, and edge cracking during the stamping or forming of a variety of parts, difficulty with welding and casting, and very high production costs associated with hot-stamping or high temperature press forming or hardening, as a result. Because of this, theses AHSS steels have limiting design flexibility and increasing manufacturing uncertainty.

Moreover, high concentrations of some alloy elements, such as carbon (C), silicon (Si) and aluminum (Al) present in boron-containing steels deteriorate the surface quality and weldability of the steel. In particular, difficulty in welding boron-containing steels has become a significant challenge for the steel in the automotive industry, and therefore further limits automotive applications of this type of steel.

SUMMARY

In a first embodiment, a cold rolled, complex metallographic structured steel is provided, comprising: (a) a composition comprising the following elements by weight: carbon in a range from about 0.02% to about 0.2%, manganese in a range from about 1.0% to about 3.5%, phosphorous less than or equal to about 0.1%, silicon less than or equal to about 1.2%, aluminum in a range from about 0.01% to about 0.10%, nitrogen less than or equal to about 0.02%, copper less than or equal to about 0.6%, vanadium less than or equal to about 0.12%, the composition having no purposeful addition of boron, and the balance of the composition comprising iron and incidental ingredients.

In a first aspect, the complex metallographic structured steel comprises a martensite phase between 30% and 70% by volume, a bainite phase between 25% and 50% by volume, and a remainder volume of essentially ferrite.

In a second aspect, alone or in combination with any of the previous aspects, the complex metallographic structured further comprises at least one chemical element chosen from molybdenum, chromium, nickel, and a combination thereof, in a range between about 0.05% and about 3.5%, wherein, if present, molybdenum (Mo) is present with chromium (Cr) satisfying a relationship Mo+Cr greater than or equal to about 0.05% and less than or equal to about 2.0%, and, wherein, if present, nickel (Ni) is present with copper (Cu) satisfying a relationship Ni+Cu of less than or equal to about 0.8% by weight.

In a third aspect, alone or in combination with any of the previous aspects, the cold rolled, complex metallographic structured steel further comprises at least one chemical element chosen from titanium, niobium and a combination thereof, in a range between about 0.005% and about 0.8%.

In a fourth aspect, alone or in combination with any of the previous aspects, the cold rolled, complex metallographic structured steel has a tensile strength greater than about 1000 megapascals.

In a fifth aspect, alone or in combination with any of the previous aspects, the cold rolled, complex metallographic structured steel comprises at least one of the following properties of elongation greater than about 10% in accordance with ASTM E8, and yield/tensile ratio greater than about 60%.

In a sixth aspect, alone or in combination with any of the previous aspects, the cold rolled, complex metallographic structured steel has a tensile strength greater than about 1000 megapascals, elongation greater than about 10% in accordance with ASTM E8, and yield/tensile ratio greater than about 60%.

In a seventh aspect, alone or in combination with any of the previous aspects, the martensite phase of the microstructure is between 30% and 70% by volume, the bainite phase is between 25% and 50% by volume, and the remainder volume being essentially the ferrite phase. In an eighth aspect, alone or in combination with any of the previous aspects, the martensite phase of the microstructure is between 30% and 70% by volume, the bainite phase is between 25% and 50% by volume, the remainder volume being essentially the ferrite phase with essentially no retained austenite.

In a second embodiment, a method of making a complex metallographic structured cold rolled steel is provided, the method comprising: a) continuously casting a molten steel into a slab, the molten steel having a composition comprising the following elements by weight: carbon in a range from about 0.02% to about 0.2%, manganese in a range from about 1.0% to about 3.5%, phosphorous less than or equal to about 0.1%, silicon less than or equal to about 1.2%, aluminum in a range from about 0.01% to about 0.10%, nitrogen less than or equal to about 0.02%, copper less than or equal to about 0.5%, vanadium less than or equal to about 0.12%, the composition having no purposeful addition of boron, and the balance of the composition comprising iron and incidental ingredients; b) hot rolling the steel slab; c) cooling the hot rolled steel; d) optionally, coiling the hot rolled steel; e) cold rolling the steel to a total cold thickness reduction in a range between 20% and 75%; f) optionally, heating the steel sheet; g) optionally, cooling the steel sheet to obtain a multi-phase microstructure; and h) optionally, metal alloy coating the sheet.

In a first aspect, the multiphase microstructure comprises, in combination, martensite between 30% and 70% by volume, bainite between 25% and 50% by volume, the remainder volume being essentially ferrite. In a second aspect, alone or in combination with any of the previous aspects, the multiphase microstructure comprises, in combination, martensite between 30% and 70% by volume, bainite between 25% and 50% by volume, the remainder volume being essentially ferrite with essentially no retained austenite.

In a third aspect, alone or in combination with any of the previous aspects, the chemical composition comprises at least one chemical element chosen from molybdenum, chromium, nickel, or a combination thereof, in a range between about 0.05% by weight and about 3.5% by weight, wherein, if present, molybdenum (Mo) is present with chromium (Cr) satisfying a relationship Mo+Cr greater than or equal to about 0.05% and less than or equal to about 2.0%, and, wherein, if present, nickel (Ni) is present with copper (Cu) satisfying a relationship Ni+Cu being less than or equal to about 0.8%. In a fourth aspect, alone or in combination with any of the previous aspects, the chemical composition comprises at least one chemical element chosen from titanium, niobium and a combination thereof, in a range between about 0.005% and about 0.8%.

In a fifth aspect, alone or in combination with any of the previous aspects, the method further comprises hot rolling the steel slab; and cooling the hot rolled steel. In a sixth aspect, alone or in combination with any of the previous aspects, the steel slab has an exit temperature in a range between about (Ar3-30)° C. and about 1025° C. (about 1877° F.) prior to hot rolling. In a seventh aspect, alone or in combination with any of the previous aspects, the steel slab is cooled at a mean cooling rate of at least about 3° C./s (about 37.4° F./s), and optionally is coiled at a temperature between about 400° C. (about 752° F.) and about 750° C. (about 1382° F.)

In an eighth aspect, alone or in combination with any of the previous aspects, the method further comprises i) optionally pickling the hot rolled steel to improve the surface quality; j) cold rolling the hot rolled steel to a desired steel sheet thickness with the cold rolling reduction at least about 20%; k) heating the steel sheet to a temperature in the range between about 650° C. (1202° F.) and about 925° C. (1697° F.) for between about 5 seconds and 1000 seconds; l) cooling the steel sheet to a temperature in the range between about 400° C. (752° F.) and about 600° C. and (1112° F.) to obtain a multi-phase microstructure; m) optionally, metal alloy coating the surface of the steel; and further cooling the sheet to ambient temperature; n) optionally, annealing the metal alloy coated steel at a temperature between about 450° C. (1842° F.) and 650° C. (1202° F.) for at least 5 seconds.

In a third embodiment, an article made by the method or the method in combination with any one of its aspects, is provided.

DETAILED DESCRIPTION

Figure 1:
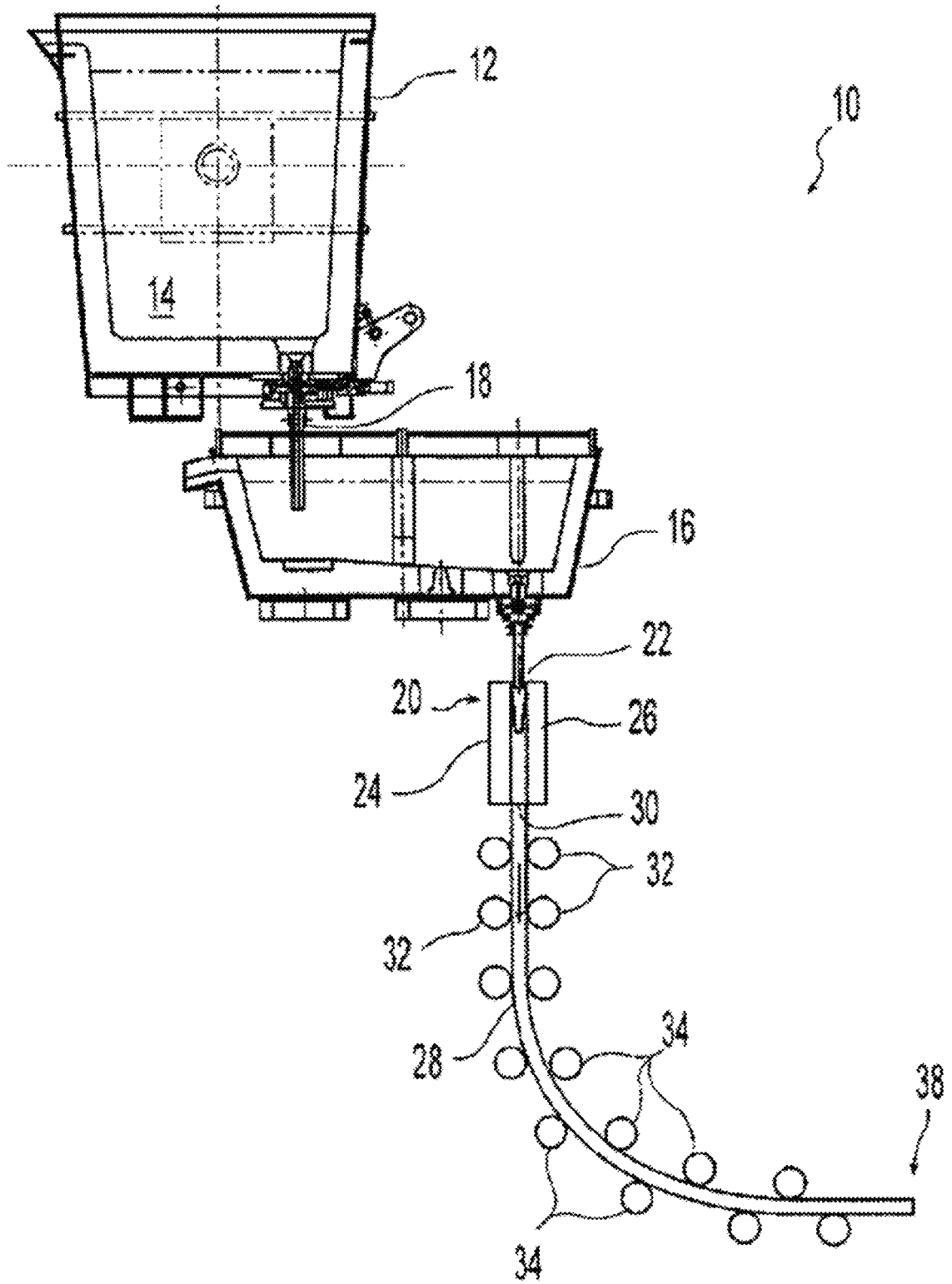
FIG. 1 is a diagrammatic a side view of a caster that may be used for producing the steel according to the present disclosure.

A metal alloy coated, high strength, complex metallographic structured or multi-phase structured steel is presently disclosed that improves forming during stamping, while possessing one or more of the following properties: excellent formability, excellent fracture resistance, excellent stretch formability, excellent stretch flangeability, excellent dent resistance, excellent durability, excellent impact performance, excellent intrusion and crash resistance and excellent weldability.

A metal alloy coated, high strength, complex metallographic structured or multi-phase structured steel is disclosed and provided comprising (a) a composition comprising the following elements by weight:

carbon in a range from about 0.02% to about 0.2%,
manganese in a range from about 1.0% to about 3.5%,
phosphorous less than or equal to about 0.1%,
silicon less than or equal to about 1.2%,
aluminum in a range from about 0.01% to about 0.10%,
nitrogen less than or equal to about 0.02%,
copper less than or equal to about 0.5%,
vanadium less than or equal to about 0.12%, at least one metal chosen from molybdenum, chromium, nickel, and a combination thereof, in a range between about 0.05% and about 3.5%, wherein, if present, molybdenum (Mo) is present with chromium (Cr) satisfying a relationship Mo+Cr greater than or equal to about 0.05% and less than or equal to about 2.0%, and, wherein, if present, nickel (Ni) is present with copper (Cu) satisfying a relationship Ni+Cu being less than or equal to about 0.8%, optionally, at least one metal chosen from titanium, niobium and a combination thereof, in a range between about 0.005% and about 0.8%, the composition having no purposeful addition of boron, and the balance of the composition comprising iron and incidental ingredients.

In one embodiment, the multiphase steel sheet of the above composition has a multi-phase microstructure, having in combination martensite between 30% and 70% by volume, bainite between 25% and 50% by volume, the remainder volume being essentially ferrite. Alternately, the martensite phase of the microstructure is between 35-65% by volume, with the bainite phase of the microstructure between 30% and about 45% by volume of the microstructure, the remainder volume being essentially ferrite.

The presently disclosed complex metallographic structured steel has a uniform microstructure essentially throughout the thickness of the sheet with some minor microstructure/morphology variations at the opposing surfaces due to contact with processing equipment and/or cooling effects.

In one embodiment, the multiphase steel sheet of the above composition has mechanical properties comprising tensile strength greater than about 1000 megapascals, yield strength at least about 600 megapascals, and at least one of the following properties of elongation greater than about 10% in accordance with ASTM E8 standard, and a yield/tensile ratio greater than about 60%.

The multi-phase steel composition includes carbon in an amount of at least about 0.01% by weight. Additional carbon may be used to increase the formation of martensite, such as at least 0.02% by weight. However, a large amount of carbon in the steel may degrade the formability and weldability, so the upper limit of carbon in the present multiphase steel is about 0.2%. In one embodiment, the multiphase steel composition comprises a carbon content of about 0.05 to about 0.1% by weight.

Manganese is present at least about 0.5% by weight in order to ensure the strength and hardenability of the multiphase steel. Additional manganese may be added to enhance the stability of forming the martensite phase in the steel, such as at least about 0.8% by weight. However, when the amount exceeds about 3.5% by weight the weldability of the steel may be adversely affected, so the manganese content is less than about 3.5% by weight. In one embodiment, the manganese content is between about 1.2 and 3.5% by weight. In one embodiment, the manganese content is between about 1.8 and 3.0% by weight.

Although no phosphorus may be present, a small amount of phosphorus can be added because in principle, phosphorus exerts a similar affect to manganese and silicon in view of solid solution hardening. However, when a large amount of phosphorus is added to the steel, the castability and rollability of the steel are deteriorated. Excess phosphorus segregates at grain boundaries and causes brittleness of the steel. Moreover, the excessive addition of phosphorus degrades the surface quality of the hot rolled steel. For these reasons, the amount of phosphorus is less than about 0.1% by weight. Alternately, the amount of phosphorus is less than about 0.08% by weight, and may be less than about 0.06% by weight. In one embodiment, the phosphorus content is between 0.001 and 0.1% by weight. In one embodiment, the phosphorus content is between 0.005 and 0.05% by weight. In one embodiment, the phosphorus content is between 0.01 and 0.02% by weight.

Calcium helps to modify the shape of sulfides. As a result, calcium reduces the harmful effect due to the presence of sulfur and eventually improves the toughness, stretch flangeability, and fatigue properties of the steel. However, in the present complex metallographic structured steel sheet, this beneficial effect does not increase when the amount of calcium exceeds about 0.02% by weight. The upper limit of calcium is about 0.02% by weight. Alternately, the amount of calcium is less than about 0.01% by weight.

Silicon is added as a strengthening element, for improving the strength of the steel with little decrease in the ductility or formability. In addition, silicon promotes the ferrite transformation and delays the pearlite transformation, which is useful for stably attaining a complex metallographic structure or multi-phase structure in the steel. However, excessive addition of silicon can degrade the surface quality of the steel. The silicon content in the multi-phase steel is less than about 1.5% by weight. Alternately, the silicon content is less than about 1.2% by weight. In one embodiment, the silicon content is between 0.1 and 1.0% by weight. In one embodiment, the silicon content is between 0.2 and 0.8% by weight.

Aluminum is employed for deoxidization of the steel and is effective in fixing nitrogen to form aluminum nitrides. The lower limit of aluminum as a deoxidization element is about 0.01% by weight. However, to preserve the ductility and formability of the steel, aluminum is less than about 0.1% by weight. Alternately, the amount of aluminum is less than about 0.09% by weight, and may be less than about 0.08% by weight. In one embodiment, the aluminum content is between 0.01 and 0.1% by weight. In one embodiment, the aluminum content is between 0.02 and 0.06% by weight.

When boron is purposely added, the rollability, castability, and other processing capabilities of the steel typically are lowered or rendered less desirable. Although no boron should be present (intentionally or purposely added) in the steel sheet of the present disclosure, the presence of a small amount of unintentionally added boron is tolerable, as it would be difficult to remove, and provided that it does not adversely affect the casting or rollability of the steel. The upper limit of unintentionally added boron content is about 0.0015% by weight (15 ppm), 0.001% by weight (10 ppm), 0.0005% by weight (5 ppm) or less.

The addition of a small amount of nitrogen may be beneficial. However, the upper limit of nitrogen content is about 0.02%. Alternately, the amount of nitrogen is less than about 0.015%, and may be less than about 0.012% by weight.

Molybdenum, chromium, copper, and nickel are effective for increasing the hardenability and strength of the steel. These elements are also useful for stabilizing the retaining austenite and promoting the formation of martensite while having little effect on austenite to ferrite transformation. These elements can also improve the impact toughness of steel because these elements contribute to the suppression of formation and growth of micro-cracks and voids. In the presently disclosed steel, the sum of the weight percent of Mo+Cr is about 0.05 to 2.0. Alternately, the sum of Mo+Cr is about 0.5 to 1.5. In the presently disclosed steel sheet, the sum of the weight percent of Ni+Cu is about 0.005 to 0.5. Alternately, the sum of Ni+Cu is about 0.1 to 0.3. In one aspect, nickel and copper are not purposefully added, however, may nonetheless be present in scrap steel at varying amounts, and if present, nickel (Ni) is present with copper (Cu) satisfying a relationship Ni+Cu of less than or equal to about 0.8% by weight.

The addition of niobium and titanium is beneficial as these alloying elements in solid solution can refine grains of the steel and increase the strength of the steel through "solution strengthening" mechanisms. Furthermore, these alloying elements may form very fine precipitates, which have a strong effect for retarding austenite recrystallization and also refining ferrite grains. These fine precipitates further increase the strength of the steel through "precipitation strengthening" mechanisms. These elements are also useful to accelerate the transformation of austenite to ferrite. One of niobium and titanium may be used alone, or they may be employed in combination, wherein, if used in combination, titanium (Ti) is present with niobium (Nb) satisfying relationship Ti+Nb greater than or equal to about 0.005% and less than or equal to about 0.3%. However, when the total content of these elements exceeds about 0.15% by weight, excess precipitates can be formed in the steel, increasing precipitation hardening and reducing castability and rollability during manufacturing the steel and forming parts. In the presently disclosed steel, the total content of niobium, titanium, or a combination thereof is limited to not more than about 0.15% by weight. In one embodiment, niobium and titanium collectively present in an amount no more than about 0.08% by weight.

In one aspect, the presently disclosed steel comprises titanium (Ti) and niobium (Nb) in a range from about 0.005% to about 0.15%. Alternately, the total content of niobium and titanium is in a range from about 0.01% to about 0.08% by weight.

In one aspect, the addition of a small amount of vanadium can be used for retarding austenite recrystallization and refining ferrite grains, and for increasing the strength of the steel. However, when the total content of this element exceeds about 0.12% by weight, excess vanadium carbides and vanadium nitrides are precipitated out in the steel. Since these types of precipitates are usually formed on grain boundaries, excess vanadium carbides and vanadium nitrides can reduce castability during producing the steel sheet, and also deteriorate the formability of the steel sheet when forming or press forming the manufactured steel sheet into the final automotive parts. Moreover, the impact toughness, fracture resistance, crashworthiness, stretch formability, stretch flangeability and fatigue property of the steel sheet could also be reduced due to the occurrence of excess vanadium carbides and vanadium nitrides. Thus, the content of vanadium in the presently disclosed steel sheet is less than about 0.1% by weight. Alternately, the amount of vanadium present in the presently disclosed steel sheet is less than about 0.02% by weight.

In one aspect, the cold-rolled, high-strength complex metallographic structured steel is absent purposely added boron (B). In another aspect, the cold-rolled, high-strength complex metallographic structured steel is absent purposely added niobium (Nb), zirconium (Zr), boron (B), and tungsten (W).

In another aspect, the presently disclosed composition can contain a purposeful addition of calcium less than or equal to about 0.01% by weight.

Incidental ingredients and other impurities should be kept to as small a concentration as is practicable. Incidental ingredients are typically the ingredients arising from use of scrap metals and other additions in steel making, as occurs in preparation of molten composition in a steel making furnace.

By employing a steel starting material falling within the above composition, the manufacturing process to make steel sheet will have less demanding facility requirements and less restrictive processing controls. Further, the process may be carried out at existing mills without any additional equipment or added capital cost.

Presently disclosed is a practical manufacturing method of reliably making the complex metallographic structured or multi-phase structured steel, which may be carried out by steel manufacturers with little or no increase in manufacturing cost.

A method of making a cold rolled complex metallographic structured steel sheet comprises: a) continuously casting a molten steel into a slab having a composition comprising the following elements by weight: carbon in a range from about 0.02% to about 0.2%, manganese in a range from about 1.0% to about 3.5%, phosphorous less than or equal to about 0.1%, silicon less than or equal to about 1.2%, aluminum in a range from about 0.01% to about 0.10%, nitrogen less than or equal to about 0.02%, copper less than or equal to about 0.5%, vanadium less than or equal to about 0.12%, at least one chosen from molybdenum, chromium, nickel, and a combination thereof, in a range between about 0.05% and about 3.5%, wherein, if present, molybdenum (Mo) is present with chromium (Cr) satisfying a relationship Mo+Cr greater than or equal to about 0.05% and less than or equal to about 2.0%, and, wherein, if present, nickel (Ni) is present with copper (Cu) satisfying a relationship Ni+Cu greater than or equal to about 0.005% and less than or equal to about 0.5%, at least one metal chosen from titanium, niobium and a combination thereof, in a range between about 0.005% and about 0.5%, wherein, if present, titanium (Ti) is present with niobium (Nb) satisfying relationship Ti+Nb greater than or equal to about 0.005% and less than or equal to about 0.3%, the composition having no purposeful addition of boron, and the balance of the composition comprising iron and incidental ingredients;

b) hot rolling the steel slab having an exit temperature in a range between about (Ar3-30)° C. and about 1025° C. (about 1877° F.);

c) cooling the hot rolled steel at a mean cooling rate of at least about 3° C./s (about 37.4° F./s);

d) optionally, coiling the steel at a temperature between about 425° C. (about 797° F.) and about 825° C. (about 1517° F.); optionally, pickling the steel to improve the service quality;

e) cold rolling the steel to a desired steel sheet thickness, with the cold rolling reduction being at least about 20%;

f) heating the steel sheet to a temperature in the range between about 650° C. (about 1202° F.) and about 950° C. (about 1742° F.) for between about 5 seconds and 1000 seconds; and g) cooling the steel sheet to a temperature in the range between about 400° C. (about 752° F.) and about 600° C. (about 1112° F.) to obtain a multi-phase microstructure having, in combination, a bainite phase of between 25% and 50% by volume, a martensite phase of between 30% and 70% by volume, the remainder volume being essentially ferrite and mechanical properties comprising tensile strength greater than about 980 megapascals and at least one of the properties of elongation greater than about 10% as determined by ASTM E8, and a yield ratio greater than about 60%. In one aspect, the cooling in step (g) may be between about 3° C./s (37.4° F./s) and 100° C./s (212° F./s).

Optionally, the cold rolling reduction may be at least about 30%. In one embodiment, the steel sheet is subsequently coated with a coating comprising one or more of zinc, aluminum, an alloy of zinc and aluminum, manganese, magnesium, or other transition metals, and silicon. The coating on the steel may be annealed after the coating has been applied, such as but not limited to a process known as galvannealing. The complex phase steel sheet can be formed and used in applications including, but not limited to, automobiles, ships, airplanes, trains, electrical appliances, building components and other machineries.

In one embodiment, a method of making a complex metallographic structured steel comprises the steps of passing the steel sheet through a bath of coating material to coat the surface of the steel sheet with the coating; and further cooling the subsequently coated sheet to a desired temperature. In one aspect, the steel sheet is passed through a molten bath of metal ("dip coated"). In another embodiment, the coated steel sheet is subsequently annealed. For example the coated steel sheet may be annealed at a temperature in a range between about 450° C. (842° F.) to 650° C. (1202° F.).

FIG. 1 is a diagrammatical illustration of a continuous metal slab caster 10. The steel slab caster 10 includes a ladle 12 to provide molten steel 14 to a tundish 16 through a shroud 18. The tundish 16 directs the molten melt 14 to the casting mold 20 through a submerged entry nozzle (SEN) 22 connected to a bottom of the tundish 16. The casting mold 20 includes at least two opposing mold faces 24 and 26, which may be fixed or movable. The SEN 22 delivers the molten melt into the casting mold 20 below the surface ("meniscus") of the molten metal in the casting mold 20.

The width of cast strand 28 leaving the casting mold 20 is determined by the configuration of the caster mold faces at the mold exit at 30. The two opposing mold faces 24 and 26 are broad mold faces, and the casting mold 20 has two opposing narrow mold faces (not shown) to form a substantially rectangular configuration, or some other desired configuration for the cast strand 28. At least one pair of the mold faces of the casting mold 20 typically is oscillating to facilitate downward movement of the molten metal through the casting mold 20. The cast strand 28 enters sets of pinch rolls 32. The sets of pinch rolls 32 serve to feed the cast strand 28 downward and toward a withdrawal straightener 34. During casting, water (or some other coolant) is circulated through the casting mold 20 to cool and solidify the surfaces of the cast strand 28 at the mold faces. The rollers of the withdrawal straightener 34 may also be sprayed with water, if desired, to further cool the cast strand 28.

Figure 2:
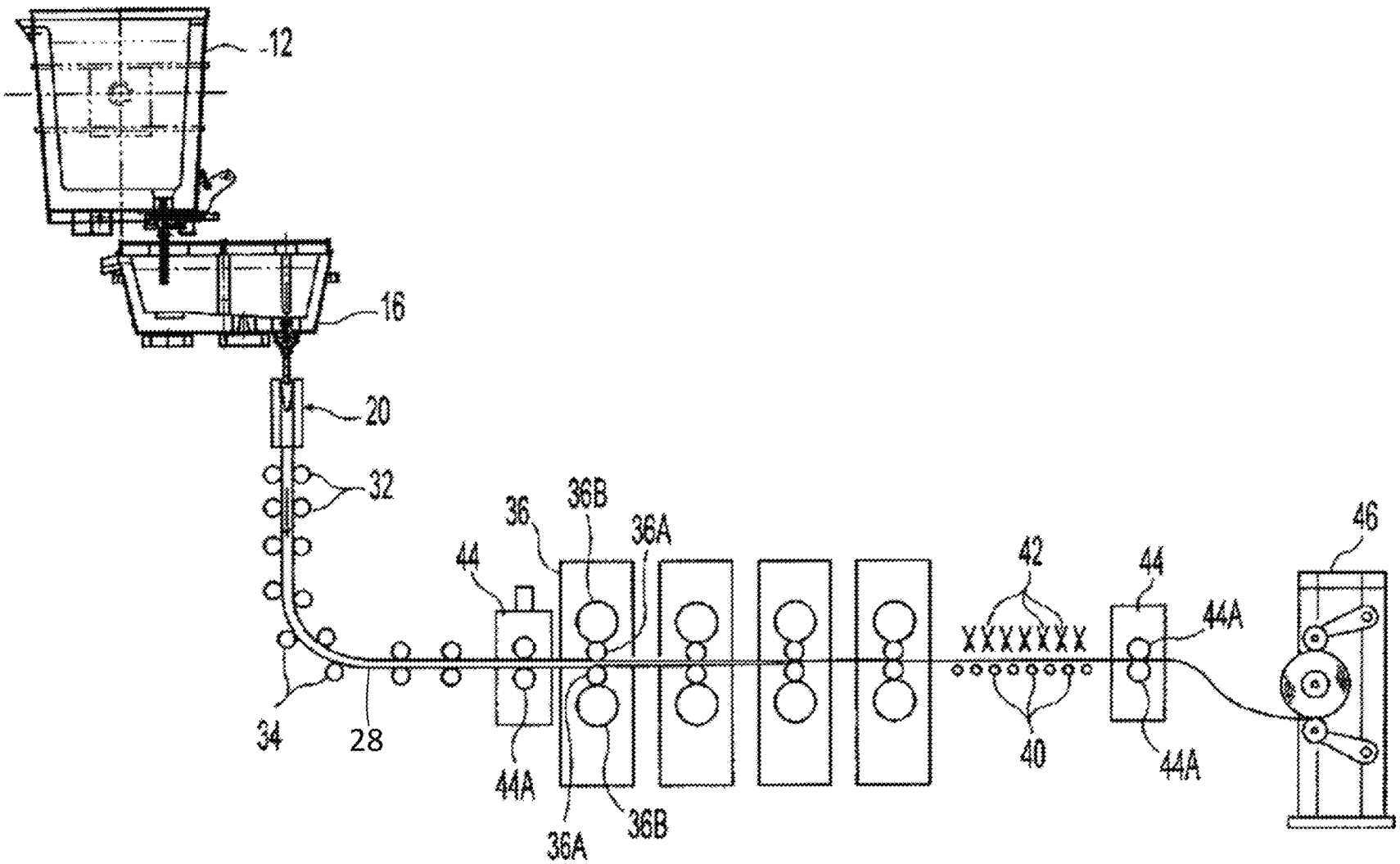
FIG. 2 is a diagrammatic a side view of a casting process including hot rolling mills according to the present disclosure.

The cast strand 28 enters the withdrawal straightener 34 which serves to transition direction of travel of the strand 28 to a substantially horizontal direction. The withdrawal straightener 34 provides support for the cast strand 28 as the strand cools and progresses at casting speed through the withdrawal straightener 34 toward at least one hot rolling mill 36 (FIG. 2). The withdrawal straightener 34 includes drives for its rolls (not shown) to move the cast strand 28 through the withdrawal straightener as casting proceeds.

Alternately, the strand 28 may be directed to a cutting tool 38, such as but not limited to a shear, after the cast metal strand exits the withdrawal straightener 34 and is sufficiently solidified to be cut laterally (i.e., transverse to the direction of travel of the cast strand). As the strand 28 is cut into slabs, blooms, or billets, for example, the intermediate product may be transported away on rollers or other supports to be hot rolled.

As shown in FIG. 2, in one embodiment, the cast strand 28 passes through at least one hot rolling mill 36, comprising a pair of reduction rolls 36A and backing rolls 36B, where the cast strip is hot rolled to reduce to a desired thickness. The rolled strip passes onto a run-out table 40 where it is cooled by contact with water supplied via water jets 42 or by other suitable means, and by convection and radiation. In any event, the rolled strip may then pass through a pinch roll stand 44 comprising a pair of pinch rolls 44A and then may be directed to a coiler 46.

Figure 3:
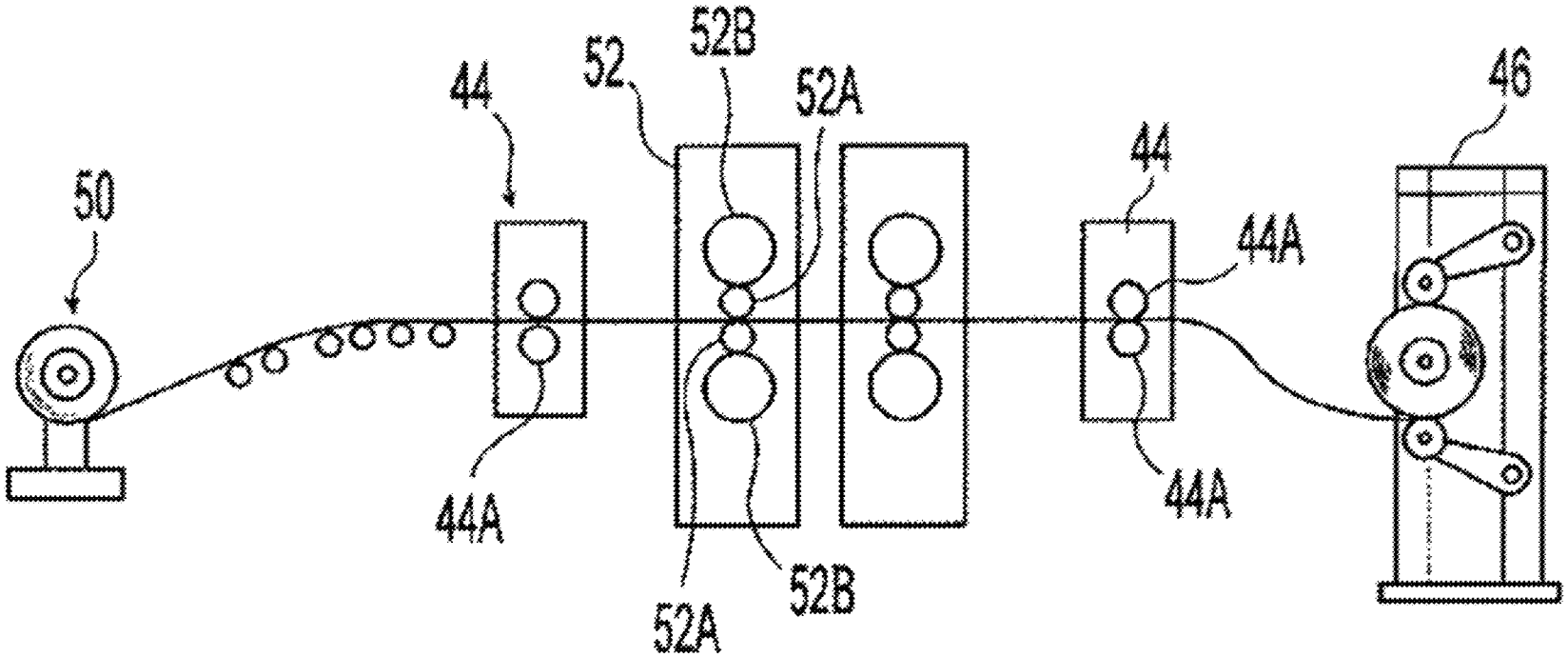
FIG. 3 is a diagrammatic a side view of a cold rolling process according to the present disclosure.

In another embodiment, the hot rolled steel is then cold rolled, and optionally, then processed through a continuous annealing and coating system or galvanizing line as further discussed below. As shown in FIG. 3, the sheet may be cold rolled by passing the sheet through at least one cold rolling mill 52. The cold rolling mill typically has a pair of reduction rolls 52A and backing rolls 52B, where the steel thickness is reduced to a desired thickness.

Figure 4:
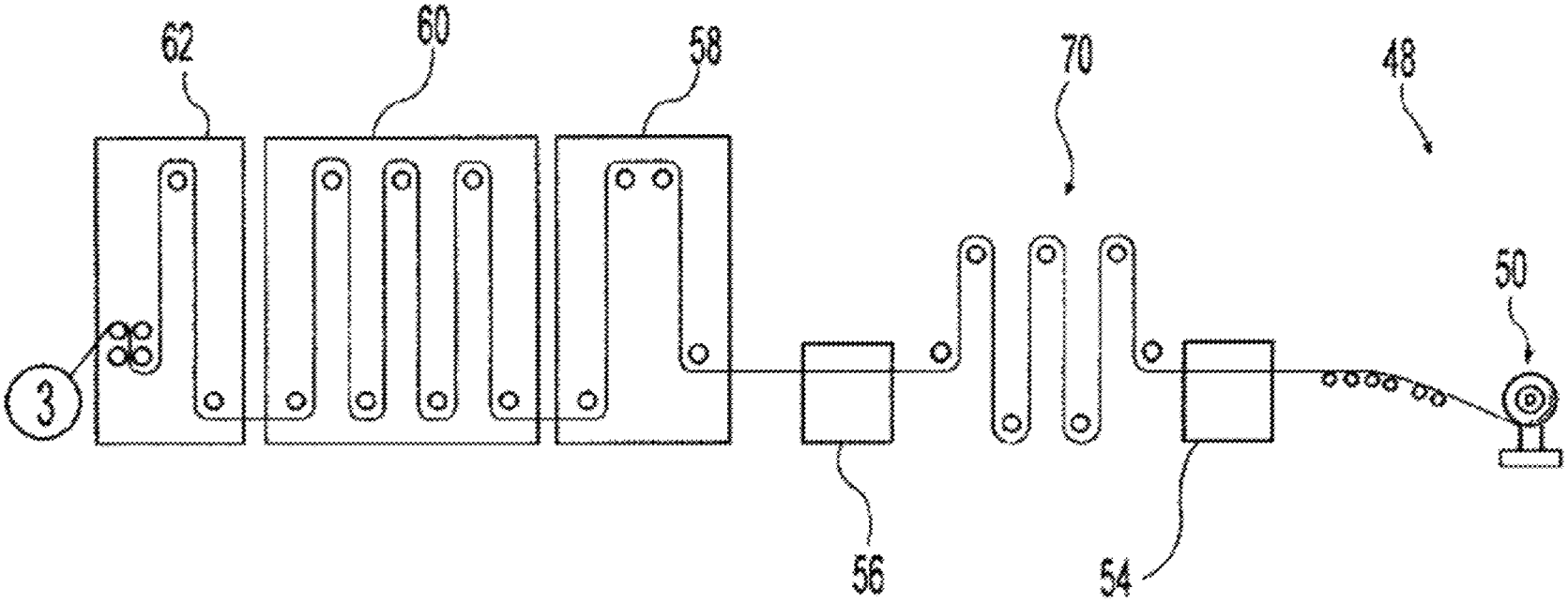
FIG. 4 is a diagrammatical side view of a portion of a continuous annealing and hot dip coating line showing the continuous annealing portion according to the present disclosure.
Figure 5:
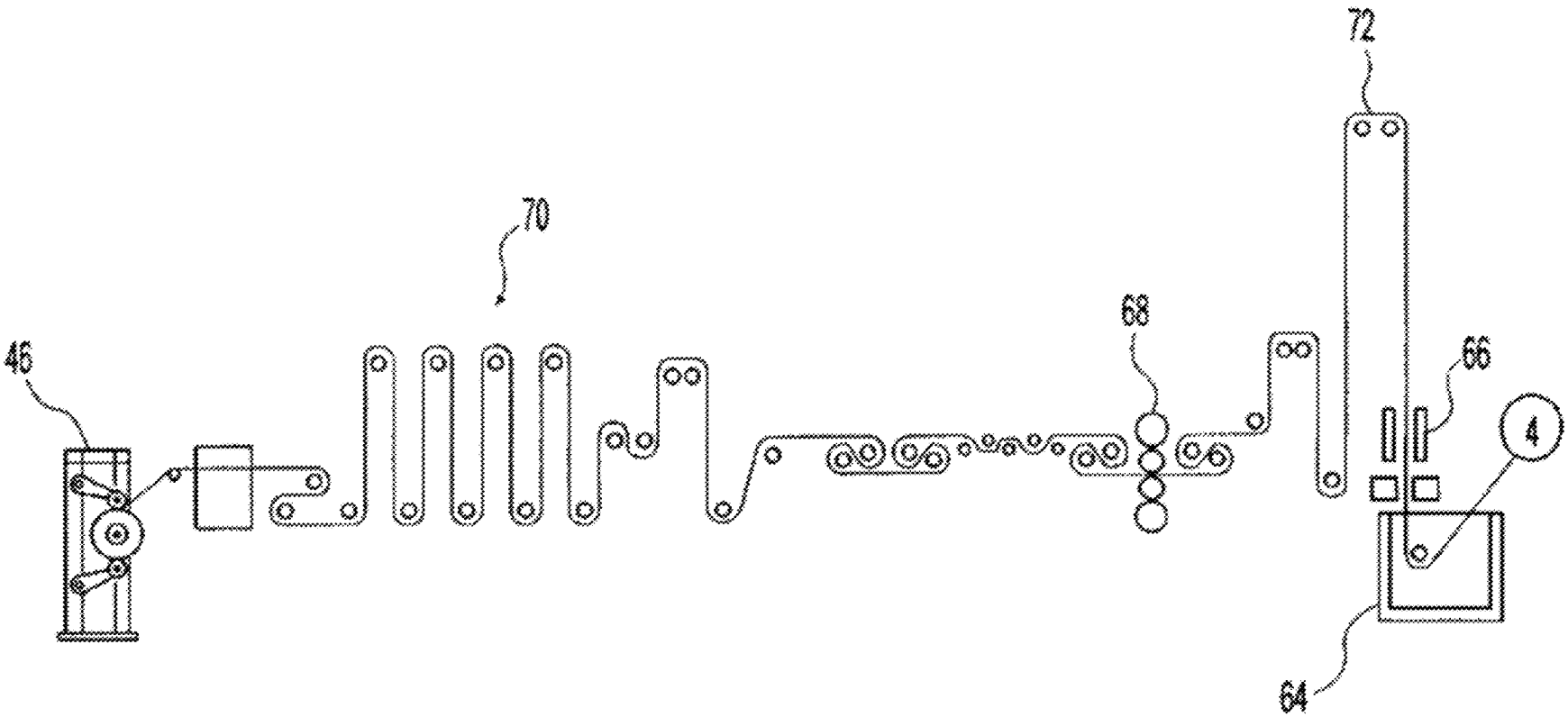
FIG. 5 is a diagrammatical side view of a portion of a continuous annealing and hot dip coating line showing the hot dip coating portion according to the present disclosure.
Figure 6A:
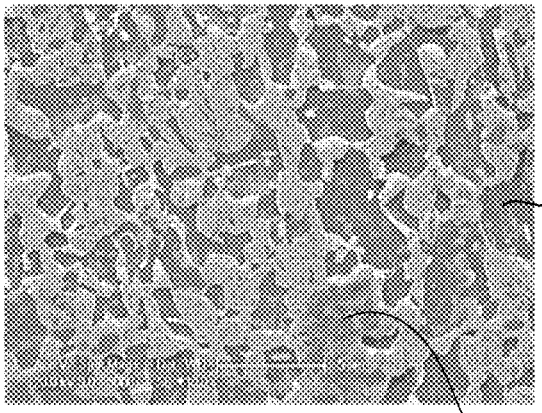
FIGS. 6A, 6B, 6C, and 6D are, respectively, scanning transmission electron microscope images of a cold-rolled sheet embodiment of the present disclosure.
Figure 6B:
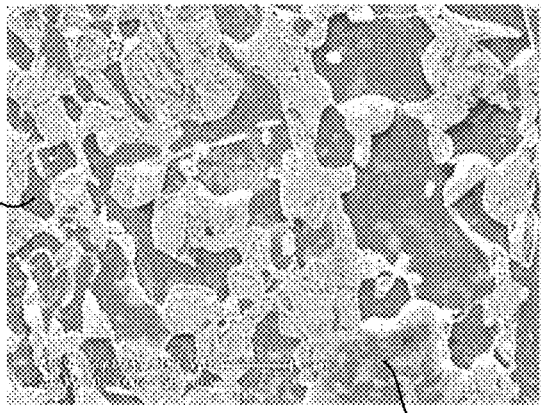
Figure 6C:
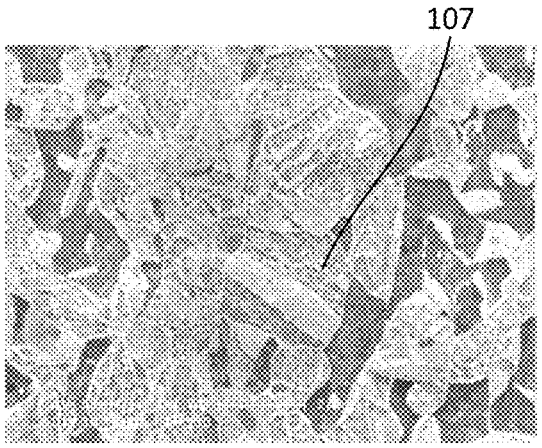
Figure 6D:
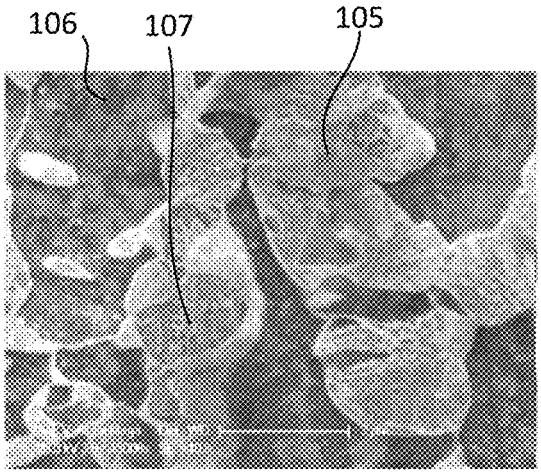

In one example of a continuous annealing and coating system shown in FIGS. 4 and 5, the continuous annealing and coating system includes a sheet feeding facility 48, in which the cold rolled steel is placed on an uncoiler 50. The steel sheet can be configured to pass through a welder (not shown) capable of joining the tailing end of one sheet with the leading end of another sheet.

The sheet can be configured to pass through a cleaning station 54 with a rinse bath 56. The continuous annealing and coating system can further includes a heating zone 58, a soaking or annealing zone 60, and a cooling zone 62. In one example, when the steel sheet reaches a temperature for coating, the sheet can be configured to pass through a galvanizing bath 64. A coating annealing furnace, or galvannealing furnace 66 can be used. The continuous annealing and coating system can include a temper mill 68, and at least one sheet accumulator 70 to accommodate variations in feeding the sheet through the continuous annealing and coating system. Cooling systems and other chemical treatments may be provided. By way of example only, as shown in FIG. 5, the steel is air cooled by traveling through an air cooling tower 72 or other cooling system.

The resultant cold rolled, annealed, coated and cooled steel of the present disclosure has high yield strength, high tensile strength, and has a complex metallographic structure, or multi-phase structure. The multi-phase microstructure having in combination bainite between 25% and 50% by volume, martensite between 30% and 70% by volume, the remainder volume being essentially ferrite.

The complex phase steel of the present disclosure has one or more of a property chosen from excellent formability, excellent fracture resistance, excellent stretch formability, excellent stretch flangeability, excellent dent resistance, excellent durability, excellent intrusion resistance, excellent crashworthiness, excellent impact performance, and excellent weldability and, in a preferred embodiment, has excellent surface and shape quality.

By excellent formability, it is meant that a total elongation higher than about 10%, and may be higher than about 12% measured based on ASTM E8 for Standard Test Methods and Definitions for Mechanical Testing of Steel Products, while the tensile strength of the steel is greater than about 980 megapascals, and may be greater than about 1000 megapascals, measured based on ASTM A370 for Standard Test Methods and Definitions for Mechanical Testing of Steel Products. Higher total elongation values may be reported when employing other tensile testing standards, such as JIS standards.

By excellent fracture resistance, excellent stretch formability and excellent stretch flangeability, it is meant that a hole expansion ratio is greater than about 30%, and may be greater than about 40%. In one aspect, a hole expansion ratio greater than 30% enables the stamping and forming of various complex parts with neither apparent shear fractures nor edge fractures. For example, when the steel sheet is formed during stabbing or forming processes that include stretching a part over a radius and stretching edge of the part, no apparent shear fractures nor edge fractures are observed.

Hole expansion ratio is determined by the Japan Iron and Steel Federation Standard JFS T1001.

By excellent dent resistance, excellent durability, excellent intrusion resistance, and excellent crashworthiness, it is meant yield strength greater than 600 megapascals, and can be greater than 700 megapascals, and a yield/tensile ratio, or the yield ratio, being higher than about 60%, and may be greater than about 70%.

By excellent weldability, it is meant that weldability is superior to the weldability of known advanced high strength steel with similar tensile strength. With respect to the weld lobe chart generated for resistance spot welding, a weld current range may be wider than 2000 amperes, and may be wider than 2200 amperes on the steel having tensile strength higher than 980 megapascals. Further, with respect to peel tests after resistance spot welding, when peel tests are performed on weld nuggets of like pieces of steel sheet, the nuggets are observed to have de minimus or no shrinkage, voids, or micro cracks, using a wide range of welding conditions. Neither interfacial separation nor a change of nugget size at longer hold time is revealed on the welded samples. With respect to the chisel tests after resistance spot welding, none of the chisel samples were separated and the base steel was deformed around the sample welds in the multi-phase steel sheets.

A very good surface and shape appearance is qualitatively observed when the sheet is pickled, and then galvanized, and optionally galvanized and galvannealed, then tension leveled or skin passed using a total elongation or extension of not more than 1%. The present complex phase steel may be manufactured by a method having the following steps:

i. Continuously casting a molten steel into a slab, with a thickness that may be between about 25 and about 100 mm, the molten steel of a composition having the following elements by weight:

a composition comprising the following elements by weight:

carbon in a range from about 0.02% to about 0.2%, manganese in a range from about 1.0% to about 3.5%, phosphorous less than or equal to about 0.1%, silicon less than or equal to about 1.2%, aluminum in a range from about 0.01% to about 0.10%, nitrogen less than or equal to about 0.02%, copper less than or equal to about 0.5%, vanadium less than or equal to about 0.12%, the composition having no purposeful addition of boron, and the balance of the composition comprising iron and incidental ingredients;

iii. Hot rolling the steel slab to form a hot rolled band, or a hot rolled sheet, and completing the hot rolling process at a finishing exit temperature, or hot rolling termination temperature, in a range between about (Ar3-30)° C. and about 1025° C. (about 1877° F.).

iv. After hot rolling, cooling the hot rolled steel at a mean cooling rate of at least about 3° C./s (about 37.4° F./s).

v. Optionally, coiling the cooled steel sheet at a temperature between about 425° C. (about 797° F.) and about 825° C. (about 1517° F.).

vi. Optionally, pickling the coil to improve the surface quality.

vii. Cold rolling the coil to a desired steel sheet thickness, with the total draft or reduction being at least about 20%.

viii. Plating by hot dip coating (also known as the galvanizing process) in order to apply a coating of zinc, aluminum, or an alloy of zinc and aluminum or an alloy of aluminum and zinc and optionally silicon onto the surface of the sheet to improve the corrosion resistance. Alternatively, the method of hot dip coating includes the steps of:

heating the steel sheet to a temperature in the range between about 650° C. (about 1202° F.) and about 950° C. (about 1742° F.), and may include holding that temperature in a soaking zone of the processing line for a desired duration;

cooling the steel sheet to a temperature in the range between about 400° C. (about 752° F.) and about 600° C. (about 1112° F.), which may be close to the temperature in a bath of coating material;

dipping the steel sheet through the bath of coating material to coat the surface of the steel sheet with the coating; and further cooling the sheet to a desired temperature. No particular cooling rate is required after the hot dipping process.

ix. Optionally, annealing the coating on the steel sheet after the hot dipping process (also known as a galvannealing treatment) by heating or reheating the steel sheet to a temperature in a range between about 450° C. (842° F.) to 650° C. (1202° F.) for a desired duration, such as for example but not limited to between about 1 and 30 seconds, or alternately, the annealing duration may be greater than 30 seconds.

x. After hot dip coating and, optionally, annealing, one or more of the processes of tension leveling, skin passing, and temper rolling may be employed to improve the surface shape of the coated steel sheet.

In some embodiments the method also includes as an initial step, assembling a continuous metal slab caster having a casting mold, such as but not limited to a compact strip production facility and introducing molten steel into the casting mold.

Alternately, after cold rolling the steel sheet may be directed to a continuous annealing line omitting the step of dipping the steel sheet through the bath of coating material.

Alternately, a steel slab thicker than 100 millimeters with the above chemical composition may be produced by continuous casting. For a thick slab, such as thicker than 100 millimeters, a reheating step may be desired prior to the hot rolling operation. In a reheating step, the steel slab is reheated to a temperature in the range between about 1000° C. (1832° F.) and about 1350° C. (2462° F.), followed by holding at this temperature for a period of not less than about 10 minutes.

In the foregoing process, steps i. through x., the complex metallographic structure may be formed by continuous annealing after cold rolling on a continuous annealing, and alternatively or in addition, a hot dip coating system or galvanizing line. The steel sheet may be formed or press formed to manufacture the desired end shapes for any final applications.

FIGS. 6A, 6B, 6C, and 6D exhibit micrographs of the present multi-phase structure steel 100. The micrographs of FIG. 6A-D were obtained at 5,000, 8,000, 10,000, and 15,000× magnification, respectively. As illustrated by these micrographs, fine hard martensite islands/particles are uniformly distributed in the matrix. The micrograph also shows the presence of ferrite phase 106, bainite or bainitic ferrite phase 107 in the steel.

Figure 7:
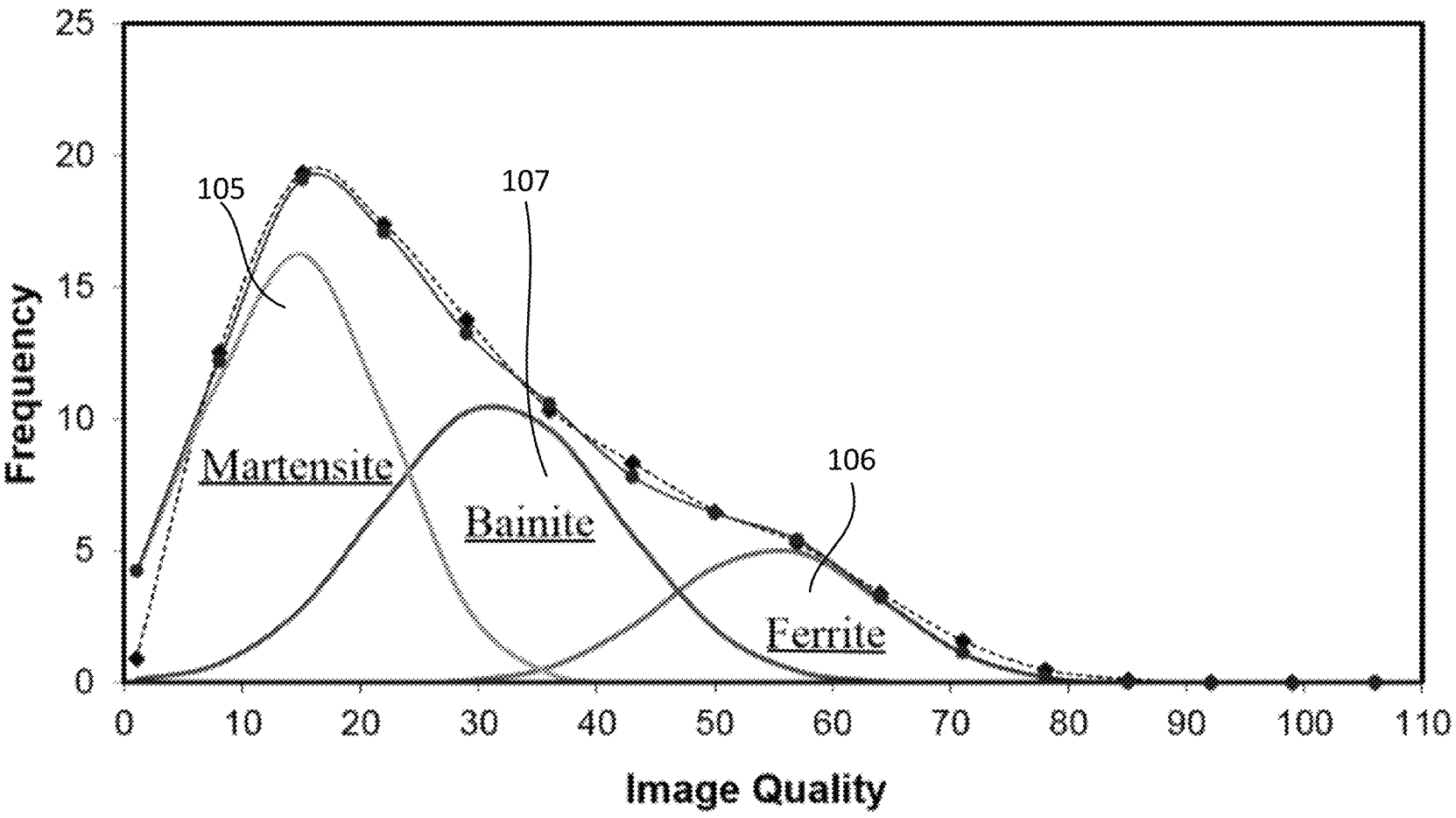
FIG. 7 is a microstructure phase distribution representation of a cold-rolled sheet according to an embodiment of the present disclosure.

FIG. 7 depicts a de-convoluted phase fraction representation of the multiphase structure of the cold-rolled steel sheet of the present disclosure.

As can be seen from FIG. 7, in the exemplary example, martensite 105 is between 30% and 70% by volume, bainite 107 between 25% and 50% by volume, the remainder volume being essentially ferrite 106. Alternately, the martensite phase of the microstructure is between 35 and 65% by volume, with the bainite phase of the microstructure between 30% and 45% by volume of the microstructure, the remainder volume being essentially ferrite. Alternately, the martensite phase of the microstructure is between 40% and 70% by volume, with the bainite phase of the microstructure between 35% and 40% by volume of the microstructure, the remainder volume being essentially ferrite. Alternately, the martensite phase of the microstructure is between about 40% and about 50% by volume, with the bainite phase of the microstructure between about 35% and about 45% by volume of the microstructure, the remainder volume being essentially ferrite.

The complex metallographic structure or multi-phase structure including martensite, bainite, the balance ferrite, with no detectable retained austenite. Further, steel sheet produced according to the present disclosure may be manufactured using existing, commercial manufacturing facilities. The composition of the complex phase steel of the present disclosure includes elements as described herein.

An alternate process for producing the complex phase steel in accordance with the present disclosure includes the following steps:

i. Continuously casting molten steel into a slab.

ii. For a thick slab, such as a thickness greater than about 100 mm, reheating in a reheating furnace to a temperature in the range between about 1025° C. (1877° F.) and about 1350° C. (2462° F.), and alternately in a range between about 1050° C. (about 1922° F.) and about 1300° C. (about 2372° F.); and holding the thick steel slab in the specified temperature range for a time period of at least about 5 minutes, and alternately at least about 60 minutes, in order to assure the uniformity of the initial microstructure of the thick slab before conducting the hot rolling process. As discussed above, for a thin slab, such as a thickness from about 25 mm to about 100 mm, the reheating process may be eliminated.

iii. Hot rolling the steel slab into a hot band, or a hot rolled sheet, and completing the hot rolling process at a finishing exit temperature, or hot rolling termination temperature, in a range between about (Ar3-30)° C. and about 1000° C. (about 1832° F.), and alternately in a range between about (Ar3-20)° C. and about 980° C. (about 1796° F.).

iv. Cooling the hot rolled steel after completing hot rolling at a mean cooling rate at least about 3° C./s (about 37.4° F./s), and alternately at least about 5° C./s (about 41° F./s).

v. Optionally, coiling the hot rolled steel by a conventional coiler when the hot band has cooled to a temperature not higher than about 825° C. (about 1517° F.). Coiling may be effected at any temperature below about 825° C. (about 1517° F.) down to the ambient temperature. Alternately, the coiling step may be performed at a temperature between about 500° C. (about 932° F.) and about 750° C. (about 1382° F.).

vi. Optionally, pickling the hot rolled coil, to improve the surface quality.

vii. Cold rolling the hot rolled and optionally pickled coil to a desired steel sheet thickness at a desired time. A conventional cold rolling stand or cold rolling mill may be used, with the cold rolling draft or reduction being at least about 20%, and alternately at least about 30%.

viii. Heating the steel sheet to a temperature higher than about 625° C. (about 1157° F.), alternately in the range between about 650° C. (about 1202° F.) and about 925° C. (about 1697° F.), and yet in another alternate about 675° C. (about 1247° F.) to about 900° C. (about 1652° F.), and then holding the sheet at the temperature for between about 10 seconds and 10 minutes. The heating and holding steps may be accomplished by passing the sheet through a conventional hot dip coating line (also known as a continuous steel sheet galvanizing line), which may have the sheet feeding facility 48, heating zone 58, soaking or annealing zone 60, cooling zone 62, and hot dip or galvanizing bath 64 as shown in FIG. 3. On the hot dip coating line, the heating and holding steps may be accomplished in the heating zone 58 and soaking or annealing zone 60. Alternately, the heating step may be done on a continuous annealing line or other processing line.

ix. Cooling the steel sheet, which may be accomplished by moving the steel sheet through the cooling zone in the continuous galvanizing line. The composition of the steel sheet maintains stabilized material properties regardless of variations in cooling pattern and rate, and therefore, a particular range for the cooling rate in this step is not required, but may be greater than 5° C./sec.

x. Discontinue cooling the steel sheet when the temperature of the sheet is reduced to a temperature close to the temperature in the galvanizing bath, the latter of which is usually set up in a range between about 400° C. (about 752° F.) and about 550° C. (about 1022° F.), alternately in a range between about 425° C. (about 797° F.) and about 525° C. (about 977° F.).

xi. Passing the steel sheet through the galvanizing bath (zinc pot, zinc alloy pot, or aluminum alloy pot) to coat the surface of the steel sheet with a coating, usually a zinc coating or a zinc alloy coating, to improve the corrosion resistance of the steel sheet. The residence time in the galvanizing bath is typically in the range of about 1 second to about 20 seconds, but may vary somewhat depending on the facility and the coating weight specified by the customer. The sheet may then be cooled; no particular cooling rate is required.

xii. Optionally, annealing the hot dip coating as an alloying treatment after the steel sheet is dipped into and removed from the galvanizing bath. This subsequent alloying process, or galvannealing, may be carried out in a conventional way, such as by heating or reheating the steel sheet to a temperature in a range from 450° C. (842° F.) to 700° C. (1292° F.), and may be from about 475° C. (about 887° F.) to about 650° C. (about 1202° F.).

xiii. Optionally, further cooling the steel after the alloying process of galvannealing as in step (xiii). A particular cooling rate during this process is not required, and may be, for instance, 3° C./s (5.4/s) or more.

xiv. After hot dip coating, such as but not limited to galvanizing, and optionally, both galvanizing and galvannealing, then one or more of the following processes may be performed: tension leveling, skin passing, or temper rolling to improve the surface shape and/or to impart the desired surface texture of the coated steel sheets. The amount of extension or elongation used during tension leveling, skin passing, or temper rolling may be selected in a range, for instance, from about 0% to about 3%, or greater according to the thickness, width and shape of the coated steel sheets, and the capability of the production facility.

xv. As desired, the present complex phase steel sheet may be formed, e.g., hot stamped, or high temperature press formed into a desired end shape for a final application.

In the foregoing process, the hot-rolled steel sheet may be directly subjected to hot dip coating (such as hot dip galvanizing and, optionally, both galvanizing and galvannealing) under similar conditions in a continuous hot dip galvanizing line as described above in steps (xi) through (xv).

In one embodiment, an initial step includes assembling a continuous metal slab caster having a casting mold, such as but not limited to a compact strip production facility and introducing molten steel having a composition having elements within the ranges discussed above into the casting mold.

In the course of developing the multi-phase steel, several types of low carbon molten steels were made using an Electric Arc Furnace and were then formed into thin steel slabs with thickness ranging from about 50 millimeters to 80 millimeters at the Nucor-Berkeley Compact Strip Production Plant, located in Huger, S.C.

The concentrations of the major chemical elements of several exemplary steels are presented in TABLE 1 below. These steels were manufactured according to the present methods, and the chemical elements of these steels, including those elements not shown in TABLE 1, were to the ranges specified by the present disclosure.

TABLE 1

Chemical compositions of exemplary samples of the presently disclosed multiphase steel sheet.

| | C | Mn | P | Si | Al | Ti + Nb | Cr + Mo | V | Cu + Ni | N |
|---|---|---|---|---|---|---|---|---|---|---|
| A | 0.080 | 2.21 | 0.013 | 0.54 | 0.034 | 0.043 | 1.1 | 0.0125 | 0.25 | 0.007 |
| B | 0.073 | 2.25 | 0.015 | 0.56 | 0.043 | 0.024 | 1.1 | 0.013 | 0.25 | 0.008 |
| C | 0.072 | 2.29 | 0.016 | 0.61 | 0.045 | 0.027 | 1.1 | 0.012 | 0.25 | 0.006 |

Each of the steel slabs was hot rolled to form respective hot bands using hot rolling termination temperatures or finishing exit temperatures ranging from (Ar3-20)° C. to 950° C. (1742° F.). Immediately after completing hot rolling, the hot rolled steel sheets were water cooled at a conventional run-out table using cooling rates faster than 5° C./s (41° F./s) down to the coiling temperatures ranging from 500° C. (932° F.) to 725° C. (1337° F.), and then were coiled at the corresponding temperatures.

After hot rolling and coiling, the hot bands were pickled to improve surface quality and then cold rolled to obtain the cold rolled steel sheets having a final thickness in a range between 1.2 mm and 2.0 mm. The cold rolling step was performed at a conventional reversing cold mill using total cold reduction in a range between 30% and 70%.

Then, the cold rolled steel sheets were hot dip galvanized at a continuous hot dip galvanizing line. Prior to dip coating, the cold rolled steel sheet was heated to a soaking temperature between about 725° C. (1337° F.) and 875° C. (1607° F.), with a soaking time between about 5 seconds and 3 minutes. Alternately, the soaking time may be between about 3 seconds and 10 minutes. The line speeds ranged from 30 meters/minute to 125 meters/minute. The temperature in the galvanizing bath (also known as a zinc alloy pot) was set in a range between 450° C. (842° F.) and 480° C. (896° F.).

Subsequently, the coated steel sheets were tension leveled and skin passed, using a total elongation or extension of not more than 1%. Good surface appearance and shape quality were observed on all of the resulting hot dip coated steel manufactured according to the present methods.

Full thickness test pieces were taken from the hot dip coated steel sheets along the longitudinal (L) and transverse (T) directions, and then the test pieces were machined into standard ASTM tensile specimens. The tensile testing was conducted in accordance with the standard ASTM E8 method on the specimens using an Instron 5567 Table Mounted Testing System with a capacity of 30 kN (6750 lb), equipped with Merlin Software.

Mechanical properties of the final thickness specimens, including the yield strength, the tensile strength and the total elongation were measured during the tensile testing. More specifically, the yield strength was determined on the specimens at an offset strain of 0.2%.

The results of the material property measurements for the present multi-phase steel sheet specimens with a final thickness of 1.5 mm are presented below in TABLE 2.

TABLE 2

Mechanical properties of exemplary samples of the presently disclosed multiphase steel sheets.

| Sample | Thickness (mm) | Test Direction | Yield Strength (MPa) | Tensile Strength (MPa) | Elongation (%) | Yield/ Tensile Ratio (%) |
|---|---|---|---|---|---|---|
| | 1.2 | L | 781 | 1125 | 11 | 74 |
| A | | T | 799 | 1142 | 12 | 76 |
| | | L | 816 | 1140 | 11 | 66 |
| | | T | 815 | 1145 | 11 | 71 |
| | 2.0 | L | 844 | 1120 | 11 | 84 |
| | | T | 904 | 1153 | 10 | 86 |
| B | 1.2 | L | 702 | 1050 | 11 | 67 |
| | | T | 723 | 1092 | 12 | 69 |
| | | L | 753 | 1028 | 11 | 72 |
| | | T | 752 | 1054 | 13 | 72 |
| | | L | 765 | 1044 | 12 | 73 |
| | | T | 771 | 1068 | 11 | 73 |
| | 1.5 | L | 683 | 1025 | 15 | 65 |
| | | T | 707 | 1016 | 14 | 67 |
| | | L | 652 | 984 | 12 | 66 |
| | | T | 654 | 988 | 12 | 66 |
| | 2.0 | L | 827 | 1073 | 12 | 79 |
| | | T | 820 | 1089 | 10 | 78 |
| | | L | 823 | 1075 | 16 | 78 |
| | | T | 813 | 1085 | 14 | 77 |
| | | L | 812 | 1042 | 12 | 77 |
| | | T | 819 | 1069 | 12 | 78 |
| C | 1.75 | L | 755 | 1025 | 11 | 72 |
| | | T | 774 | 1063 | 12 | 74 |
| | 2.0 | L | 785 | 1040 | 13 | 75 |
| | | T | 837 | 1079 | 10 | 80 |
| | | L | 729 | 1007 | 11 | 69 |
| | | L | 855 | 1082 | 10 | 79 |
| | | T | 865 | 1107 | 10 | 78 |
| | | L | 852 | 1085 | 11 | 79 |
| | | T | 860 | 1107 | 11 | 78 |

T = transverse direction;
L = longitudinal direction.

The material property data shown in TABLE 2 illustrate that the present hot dip coated complex metallographic structured or multi-phase structured steel exhibit high tensile strength as well as high elongation, indicating that these steels have a good combination of strength and formability.

The yield strength is one parameter characterizing the dent resistance, durability and crashworthiness of steel. Higher yield strength improves dent resistance, durability and crashworthiness of the steel sheet. Accordingly, the hot dip galvanized complex metallographic structured or multi-phase structured steel manufactured according to the presently disclosed method possess better dent resistance, better durability, better intrusion resistance and better crashworthiness, compared to the commercial dual phase steel with a similar tensile strength. For this reason, the present multi-phase steel may enable certain sheet metal parts to be manufactured easier than they would be using prior art steel, providing design flexibility and improving efficiency.

Similar observations on the yield/tensile ratio, or the yield ratio, may be made in TABLE 2, where the presently hot dip galvanized complex metallographic structured or multi-phase structured steel exhibits comparable yield ratios of those associated with commercial cold-rolled boron-containing steel. For example, the yield ratio of the present multi-phase steel having no purposefully added boron is higher than 65%. This property further demonstrates that the dent resistance, durability, intrusion resistance and crashworthiness of the present multi-phase hot dip coated steel is equivalent to those associated with the commercial boron-containing high strength steel with a similar tensile strength.

The complex metallographic structured or multi-phase structured steel manufactured in accordance with the present method may be hot stamped or cold stamped and/or resistance spot welded or laser or arc welded into desired parts without any difficulty, whereas the commercial boron-containing dual phase steel will likely encounter various forming problems during a stamping process as well as welding issues to make the same kinds of parts. Neither apparent shear fractures nor edge fractures were observed with the present multi-phase steel during the stamping or forming processes, comparable to commercial cold-rolled boron-containing steel. The stamping or forming processes included a process of stretching a part over a radius and a process of stretching an edge of the part.

A significant challenge using ultra-high strength steels is achieving good weldability. In order to evaluate weldability, resistance spot welding testing, gas metal arc welding testing and laser beam welding testing were conducted on exemplary samples of the presently disclosed cold rolled, hot dip galvanized multiphase or complex metallographic structured steel sheet with a 1.5 mm thickness and samples that were not galvannealed.

For the resistance spot welding evaluation, a WSI pedestal resistance spot welder was used. The employed weld control and weld checker were Miyachi ISA-500 AR MFDC and Miyachi MM-370A, respectively. An MTS 810 Materials Test system was used for the tensile testing and a Nikon SMZ800 Microscope was used for microstructure examination. The resistance spot weldability procedure consists of weld lobe generation, electrode life test, shear tension test, cross tension test, metallurgical examination and microhardness test.

Figure 8:
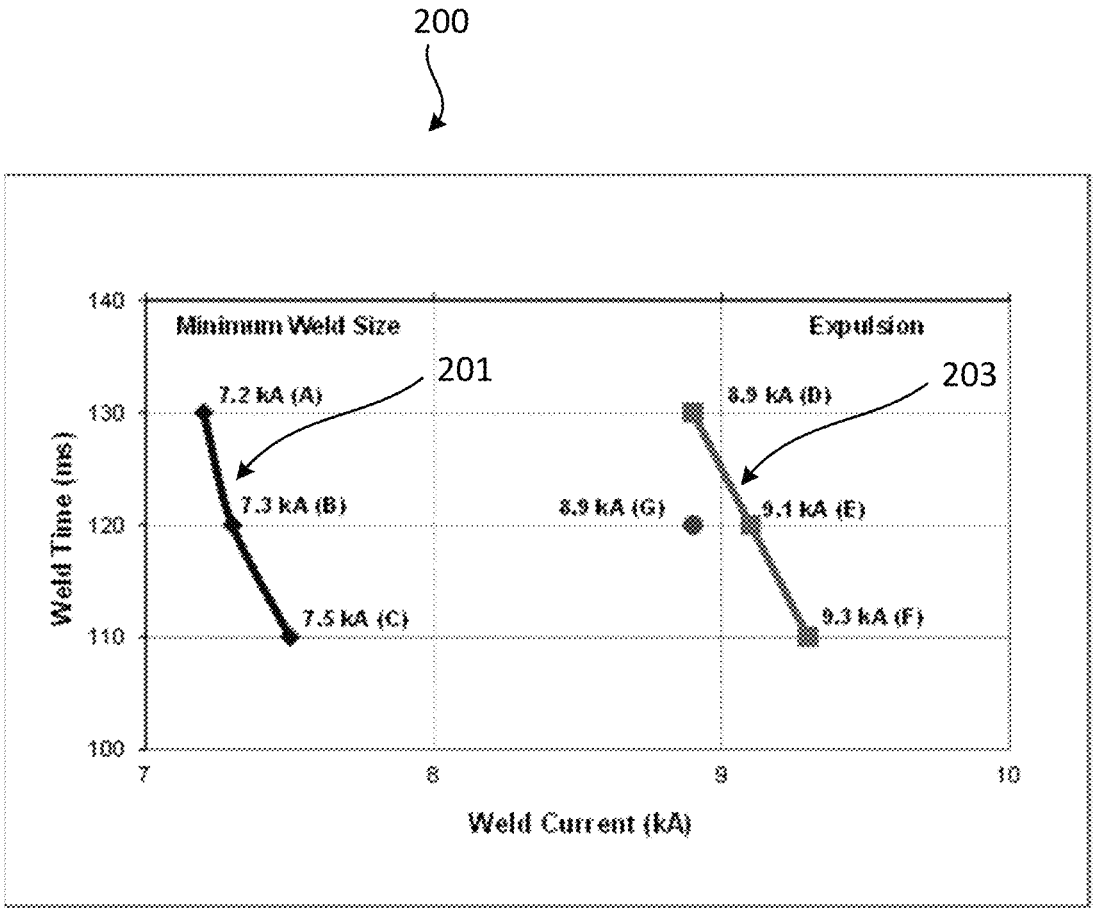
FIG. 8 is a resistance spot weld lobe diagram generated of a cold-rolled, galvanized, ultra-high strength, multiphase or complex metallographic structured steel sheet manufactured according to an embodiment of the present disclosure.
Figure 9A:
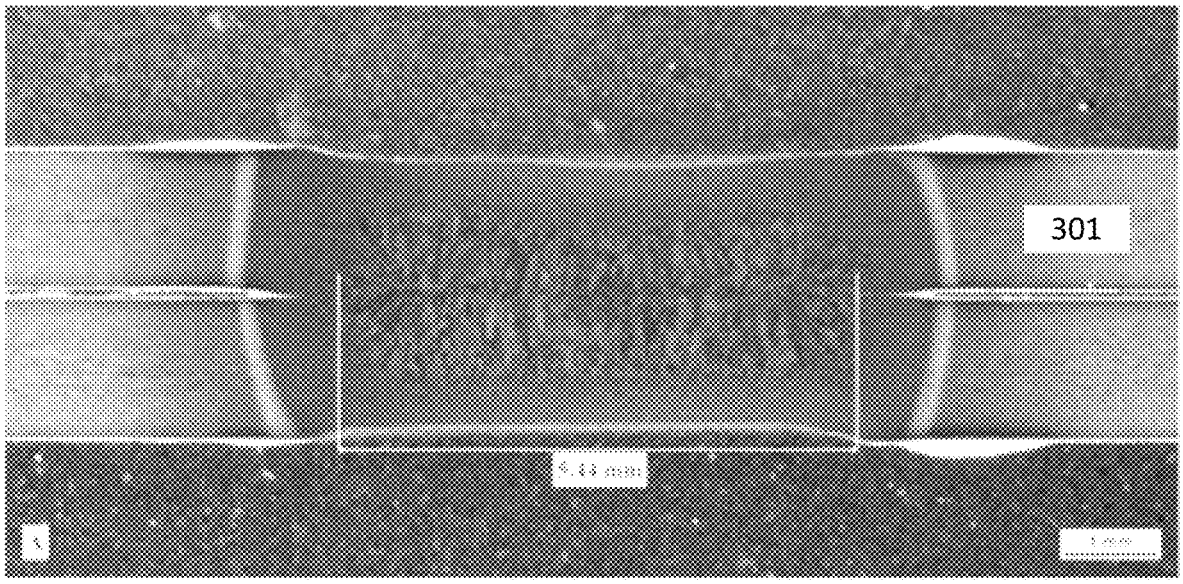
FIGS. 9A, 9B, 9C, 9D, 9E, 9F, 9G are optical microscope images of exemplary resistance spot welds corresponding to the weld lobe diagram shown in FIG. 7, respectively.
Figure 9B:
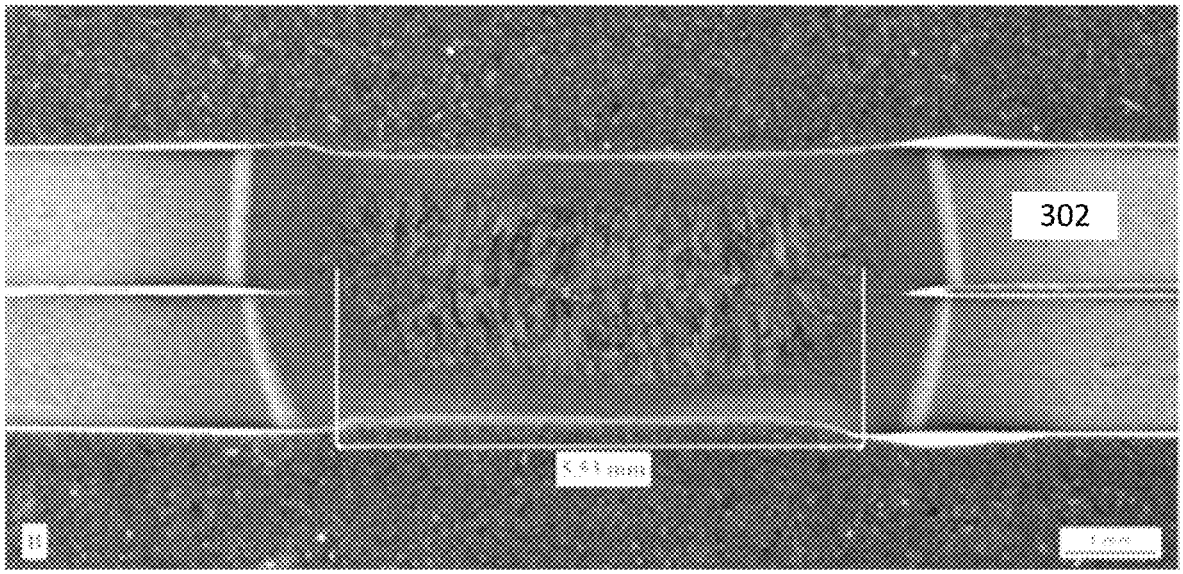
Figure 9C:
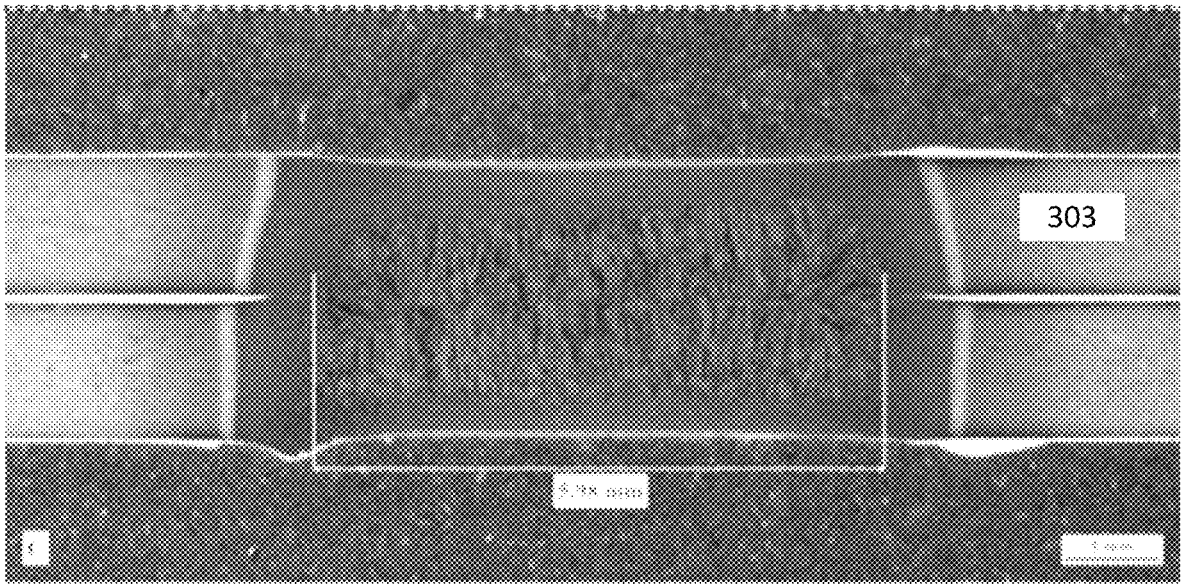
Figure 9D:
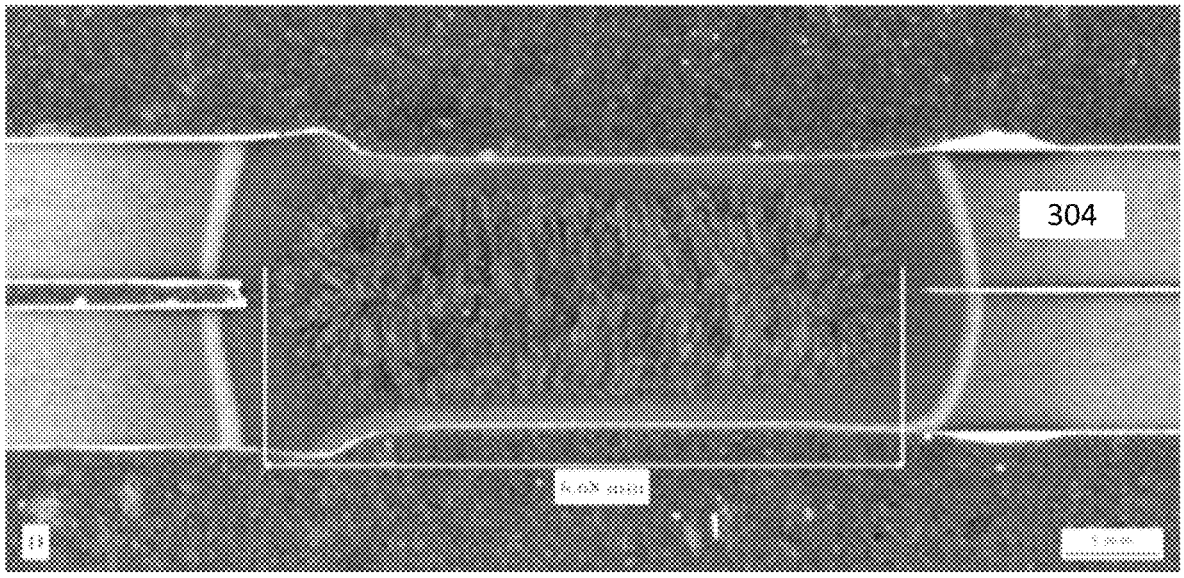
Figure 9E:
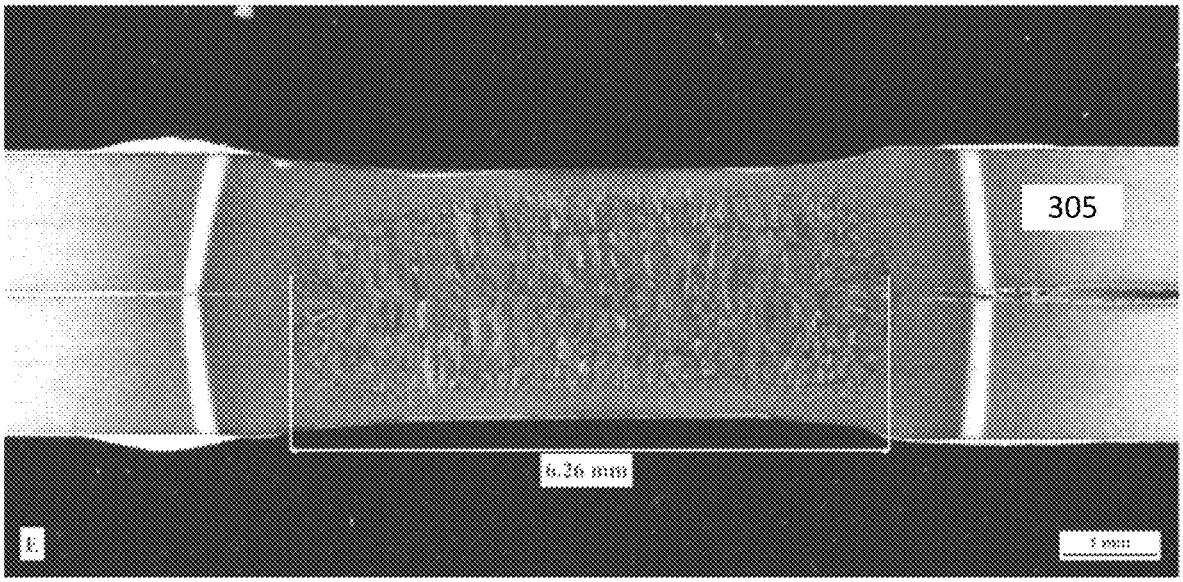
Figure 9F:
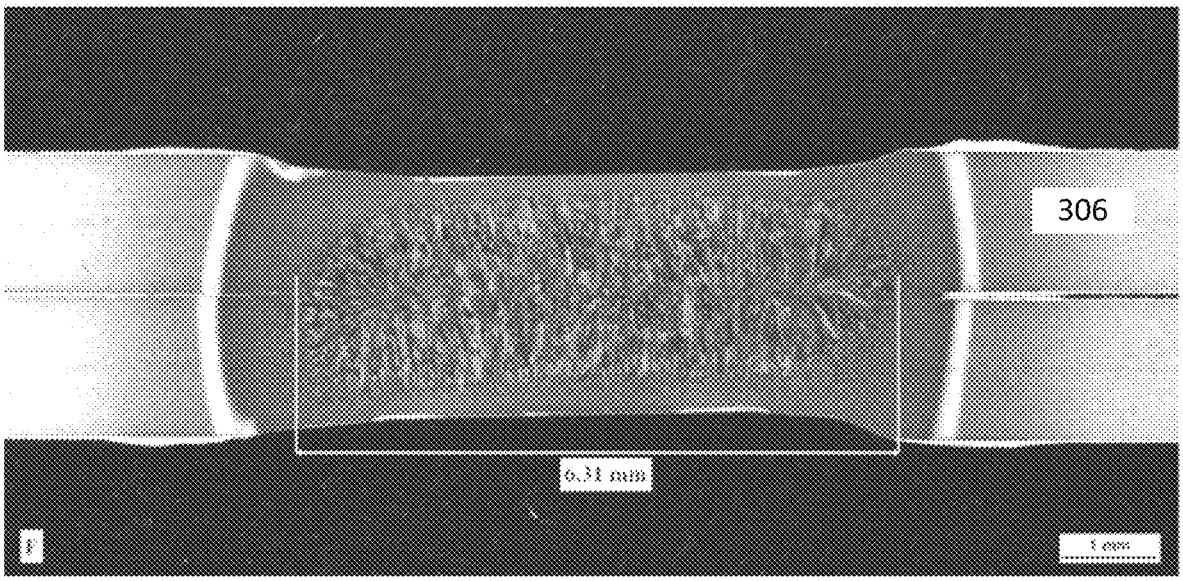
Figure 9G:
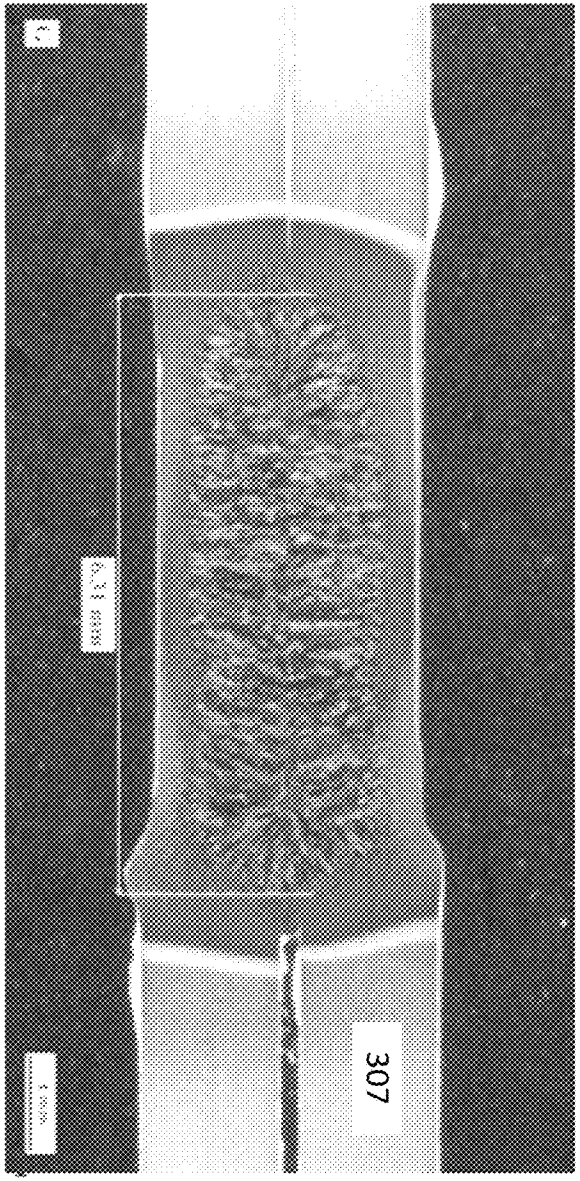
Figure 10A:
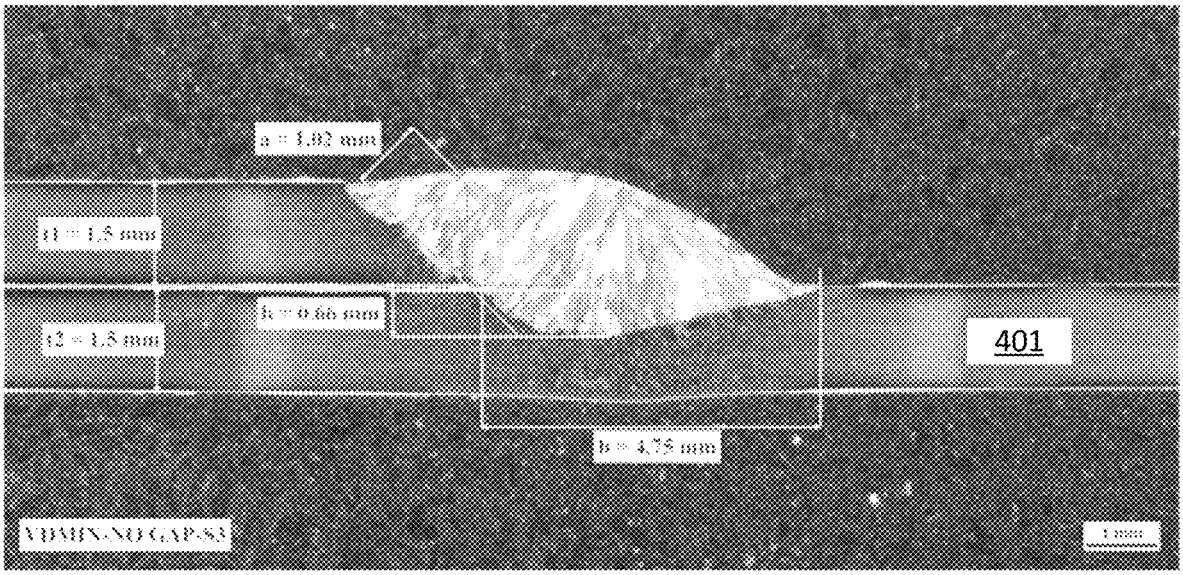
FIGS. 10A, 10B, 10C, 10D, 10E, 10F, 10G, and 10H are exemplary optical cross-section images of gas metal arc welds of the present disclosure.
Figure 10B:
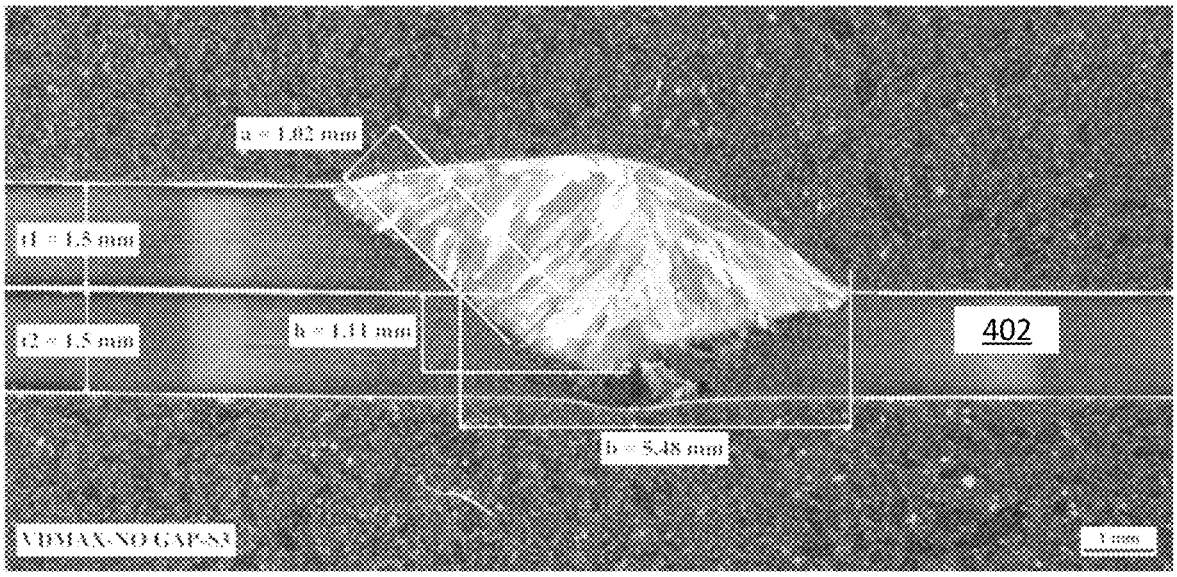
Figure 10C:
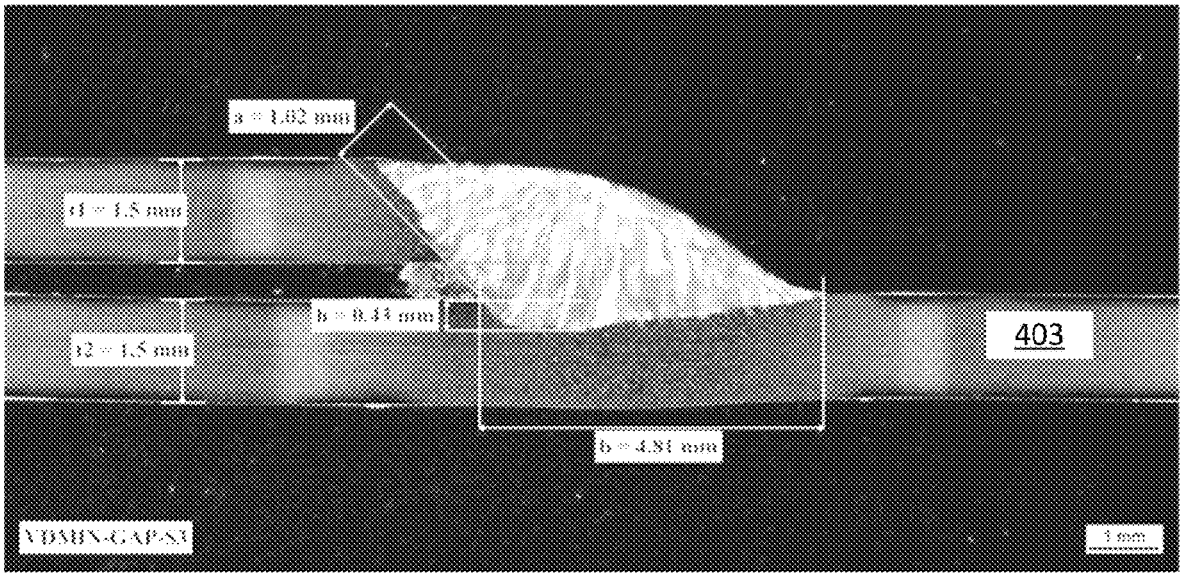
Figure 10D:
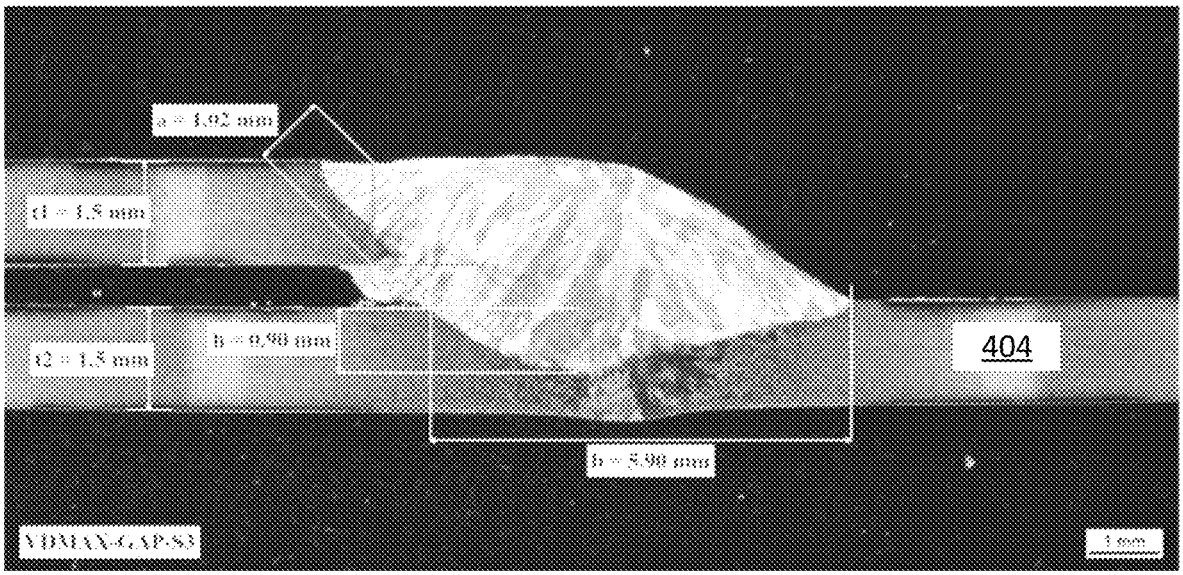
Figure 10E:
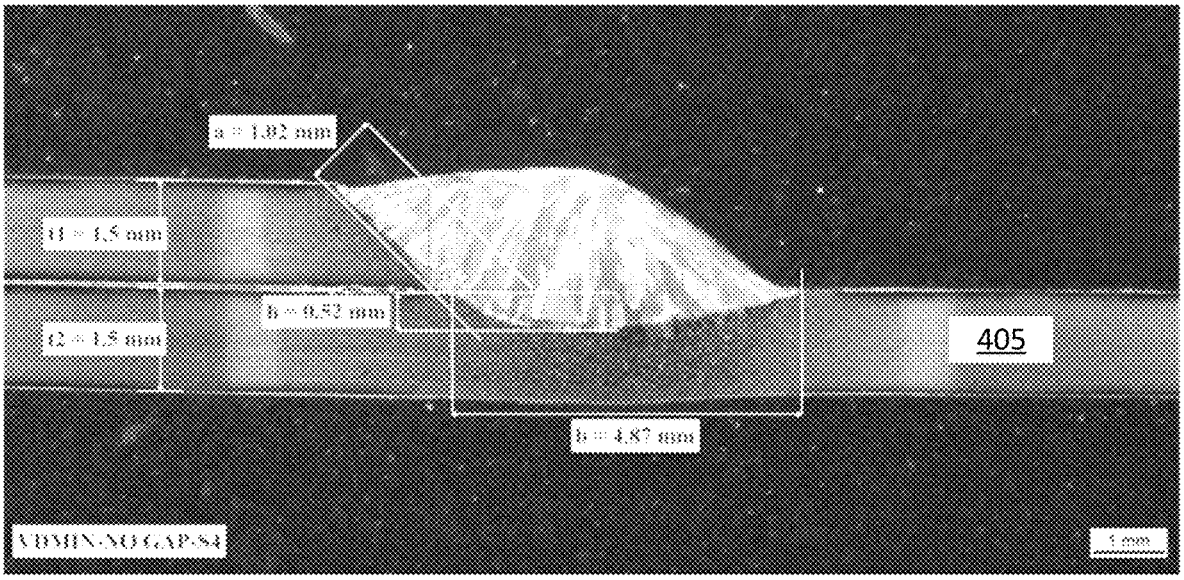
Figure 10F:
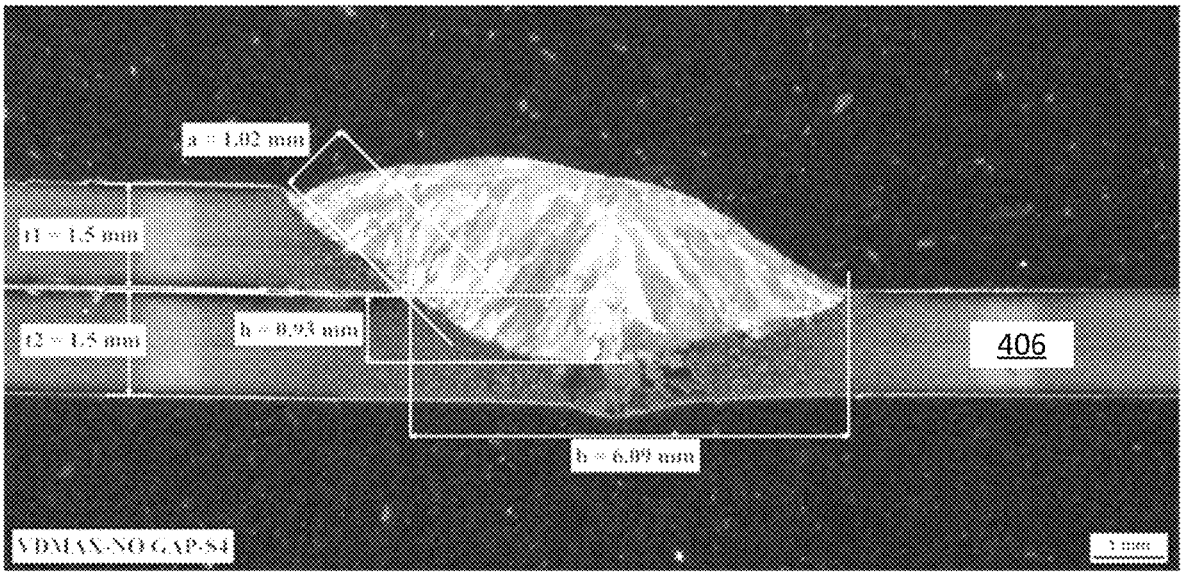
Figure 10G:
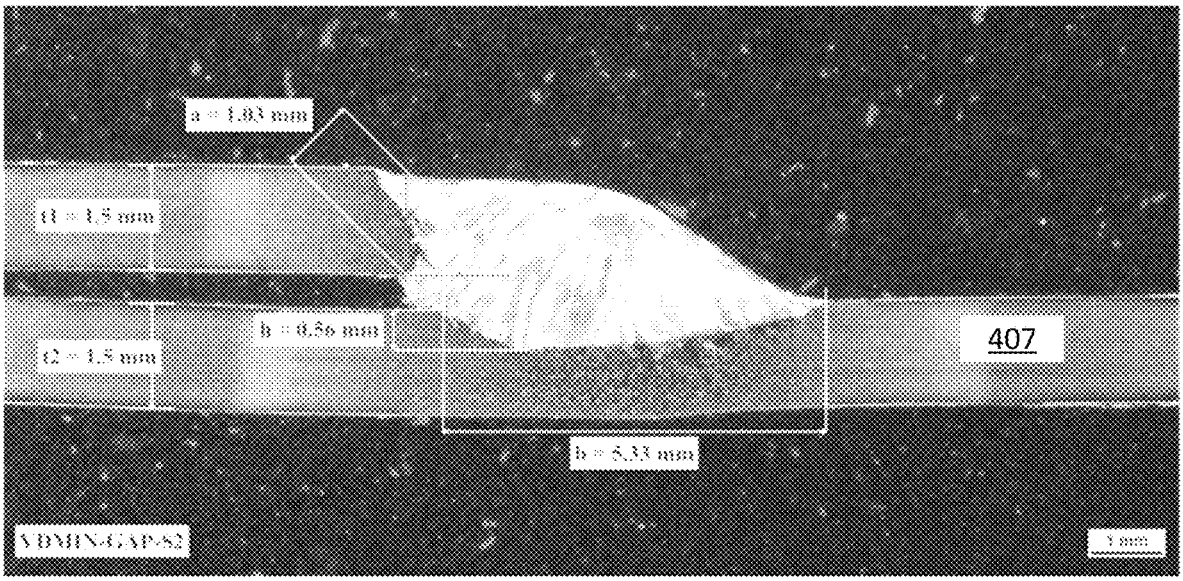
Figure 10H:
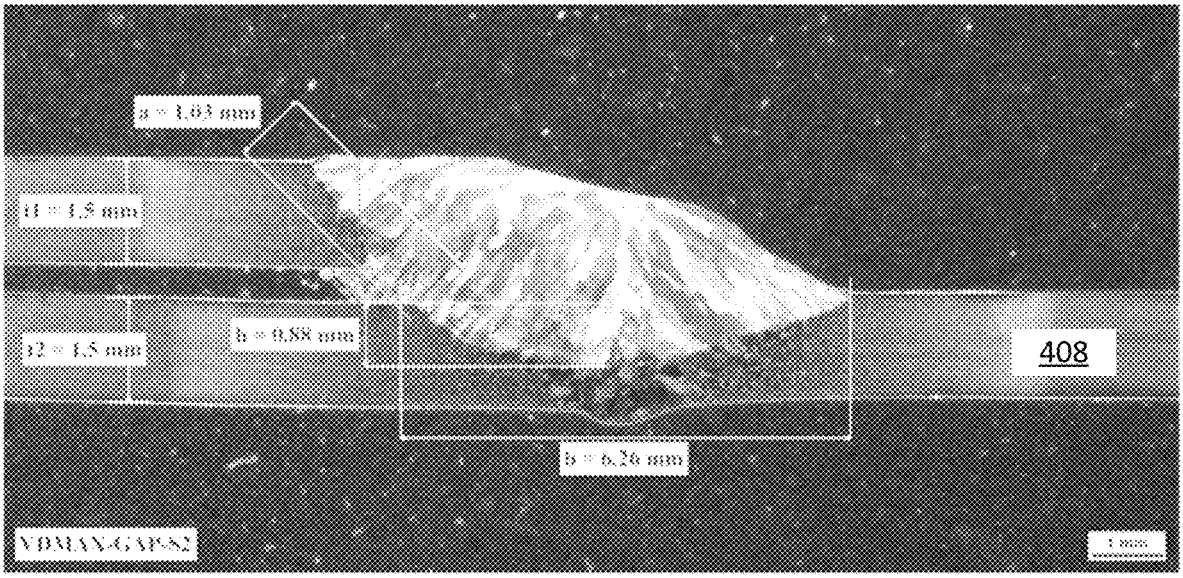

After installing and aligning the electrode caps, the squeeze time was adjusted to ensure consistent electrode force. Before welding was started, the electrode alignment was verified. Welding begins by finding the current required to produce the minimum nugget diameter, or minimum weld size, at the nominal weld time. A number of conditioning spot welds were first produced until the process appeared stable. After electrode conditioning, steel specimens were welded and peel tested in 100 A (amp) increments to determine the current that produced point A (minimum weld size at the maximum weld time) of the weld lobe diagram 200 as shown in FIG. 8. Three specimens were produced and peel tested using the determined weld current.

As presented in FIG. 8, the weld lobe diagram was generated by establishing the minimum weld size curve and expulsion curve. The minimum weld size curve 201 is composed of points A, B and C. These locations represent the current necessary to produce the minimum weld size at each of the three different weld times. The three weld times in this case were the maximum weld time, nominal weld time, and the minimum weld time. The expulsion curve 203 was established by increasing weld current in 200 A increments until expulsion was observed on the second spot weld of the test specimen. The expulsion procedure was also conducted for each of the three weld times resulting in point D, E and F on the weld lobe.

The weld lobe width is the operating range to make the desired weld before causing expulsion. A wider lobe width provides a greater operating range for welding operation. The testing results of the presently disclosed cold rolled, hot dip galvanized, ultra-high strength, multiphase or complex metallographic structured steel demonstrate wider current ranges measured compared to conventional boron-containing steel sheet or prior cold rolled hot dip galvanized steel sheet of a similar strength. The current range for each measured weld time on the present multi-phase steel sheet is wider than 1.5 kA, and may be wider than 1.7 kA.

For each point of the weld lobe, three shear tension specimens and three cross tension specimens were produced. One specimen was produced for each point for microstructural examination and microhardness testing. Shear tension and cross tension tests were performed and the peak loads were recorded. An additional specimen was produced at point G of the weld lobe diagram for microstructure examination and microhardness testing. Shear tension and cross tension testing results of exemplary samples prepared and welded as described herein are summarized in TABLES 3 and 4, respectively.

TABLE 3

Shear Tension Test Data
Tensile Shear

| Weld No. | Weld Lobe Position | Peak Load (N) | Button/Fused Area Diameter (mm) |
|---|---|---|---|
| 1 | A | 17,003 | (5.6) |
| 2 | A | 17,023 | (5.6) |
| 3 | A | 17,075 | (5.6) |
| Average | A | 17,034 | |
| 1 | B | 16,911 | (5.5) |
| 2 | B | 15,617 | (5.3) |
| 3 | B | 16,127 | (5.4) |
| Average | B | 16,218 | |
| 1 | C | 16,426 | (5.3) |
| 2 | C | 16,370 | (5.6) |
| 3 | C | 16,156 | (5.7) |
| Average | C | 16,317 | |
| 1 | D | 18,352 | (6.0) |
| 2 | D | 23,172 | (7.0) |
| 3 | D | 20,177 | (6.3) |
| Average | D | 20,567 | |
| 1 | E | 17,131 | (5.9) |
| 2 | E | 17,324 | (6.2) |

TABLE 3-continued

| Shear Tension Test Data Tensile Shear | | | |
|---|---|---|---|
| Weld No. | Weld Lobe Position | Peak Load (N) | Button/Fused Area Diameter (mm) |
| 3 | E | 18,273 | (6.2) |
| Average | E | 17,576 | |
| 1 | F | 18,118 | (6.3) |
| 2 | F | 17,564 | (6.2) |
| 3 | F | 19,197 | (6.2) |
| Average | F | 18,293 | |
| Average | All | 17,668 | |

TABLE 4

| Cross Tension Test Data Cross Tension | | | |
|---|---|---|---|
| Weld No. | Weld Lobe Position | Peak Load (N) | Button/Fused Area Diameter (mm) |
| 1 | A | 11,716 | 5.3 |
| 2 | A | 9,331 | 4.9 |
| 3 | A | 12,221 | 5.7 |
| Average | A | 11,089 | |
| 1 | B | 10,739 | 5.7 |
| 2 | B | 10,600 | 5.4 |
| 3 | B | 10,855 | 5.4 |
| Average | B | 10,731 | |
| 1 | C | 11,022 | 5.6 |
| 2 | C | 11,056 | 5.2 |
| 3 | C | 12,111 | 5.8 |
| Average | C | 11,396 | |
| 1 | D | 11,952 | 6.9 |
| 2 | D | 9,446 | 5.7 |
| 3 | D | 11,650 | 6.4 |
| Average | D | 11,016 | |
| 1 | E | 8,334 | 5.5 |
| 2 | E | 10,257 | 6.5 |
| 3 | E | 8,165 | 6.2 |
| Average | E | 8,919 | |
| 1 | F | 9,335 | 5.4 |
| 2 | F | 10,261 | 5.7 |
| 3 | F | 9,060 | 5.8 |
| Average | F | 9,552 | |
| Average | All | 10,451 | |

Of the resistance spot welded samples taken from the presently disclosed cold rolled, hot dip galvanized, ultra-high strength, multiphase or complex metallographic structured steel, the weld nuggets were observed to have no shrinkage voids or micro cracks within the weld lobe. FIGS. 9A, 9B, 9C, 9D, 9E, 9F and 9G are optical microscope images of the welds generated at Points A, (represented by sample 301), B, (represented by sample 302), C, (represented by sample 303), D, (represented by sample 304), E, (represented by sample 305), F, (represented by sample 306), and G, (represented by sample 307), on the weld lobe diagram, respectively. The examination on these welded samples revealed neither micro cracks nor a defect on the resistance spot welds.

In order to conduct the gas metal arc welding evaluation, an OTC Almega AX-V6 Robert was employed. Two gap conditions, zero gap and 0.5 mm gap, were tested. With a zero gap condition, wire feed speed was increased in increments of 0.2 m/minute until a stable arc was achieved, weld penetration exceed 10% and the throat thickness exceeded 70% of the steel sheet thickness. This wire feed speed is defined as the lower quality limit, VDMIN, and was determined to be 6.0 m/minute. The wire feed speed was then increased until a weld was produced just before excessive penetration. This wire feed speed is defined as the upper quality limit, VDMAX, and was determined to be 8.2 m/minute. The range between the lower and upper quality limits is therefore 2.2 m/minute.

Using the quality limits determined, both continuous lap welding and stitch lap welding tests were conducted. Of the gas metal arc welded samples taken from the presently disclosed cold rolled, hot dip galvanized, ultra-high strength, multiphase or complex metallographic structured steel, all the continuous lap welds and stitch lap welds, with both zero gap and 0.5 mm gap, were observed to have no voids or micro cracks within the quality limit range.

FIGS. 10A, 10B, 10C, 10D, 10E, 10F, 10G and 10H are, respectively, exemplary optical cross-section images of gas metal arc welds of a cold-rolled, galvanized, multiphase, ultra-high strength steel sheet samples 401, 402, 403, 404, 405, 406, 407, and 408, respectively, of the present disclosure generated under conditions (A) continuous lap welding with zero gap at VDMIN, (B) continuous lap welding with zero gap at VDMAX, (C) continuous lap welding with 0.5 mm gap at VDMIN, (D) continuous lap welding with 0.5 mm gap at VDMAX, (E) stitch lap welding with zero gap at VDMIN, (F) stitch lap welding with zero gap at VDMAX, (G) stitch lap welding with 0.5 mm gap at VDMIN, and (H) stitch lap welding with 0.5 mm gap at VDMAX, where t1 and t2 equal to the steel sheet thickness, a equals to the weld throat, b equals to the weld width and h equals to the weld penetration, respectively.

During the laser beam welding evaluation, an YLR-5000 Fiber Laser with BIMO laser processing head was employed. The maximum laser welding speed was determined for single sheet and lap joint specimens. The gap between the lap joint specimens was 0.1 mm. The laser power was set to 3.6 kW. All welding except for hot cracking samples was done with the laser power ramped down 50% in the last 10% of the weld. Laser welding speed was increased in increments of 0.2 m/min until the maximum welding speed was achieved. The maximum welding speeds are defined as the speed at which on the root side of the weld, a continuous seam can just be distinguished, which were determined, respectively, to be 4.8 m/minute for a single sheet and to be 3.0 m/minute for a lap joint.

Figure 11:
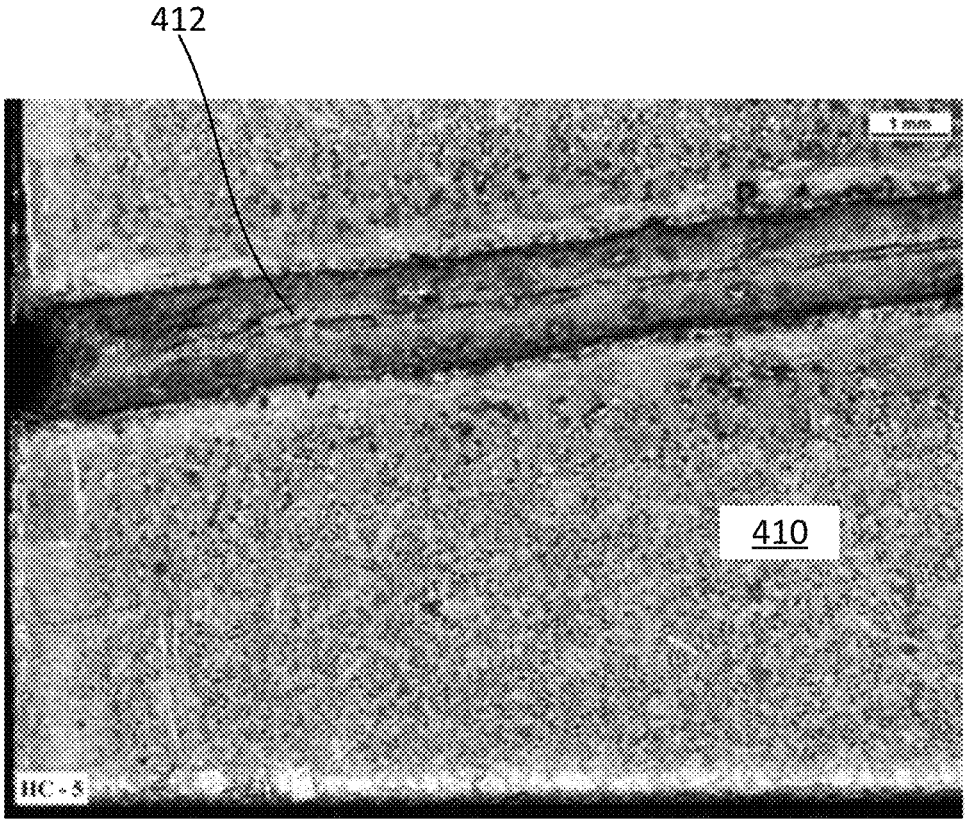
FIG. 11 is an optical microscope image showing a typical hot cracking test specimen exhibiting no cracks according to an embodiment of the present disclosure.

Hot cracking specimens were laser beam welded in a clamping jig. The weld seam angle relative to the specimen length was 7°. The weld seam was started 3 mm from the coupon edge, using 4.0 kW laser power at the maximum speed of 4.8 m/minute. All of the tested hot cracking specimens taken from the presently disclosed cold rolled, hot dip galvanized, ultra-high strength, multiphase or complex metallographic structured steel, exhibited no cracking. An optical microscope image showing a typical hot cracking test specimen 410 with weld 412 having no cracks is presented in FIG. 11.

Continuous lap joint weld panels was laser beam welded with a 16 mm overlap and a 480 mm weld length. The weld seam was positioned at the center of the overlap. 0.1 mm thick shims were placed between the sheets to produce a pre-welded gap of 0.1 mm. The laser power was set to 4.0 kW with a welding speed of 3.0 m/minute. Steel sheet dimensions were 500×120 mm (120 mm corresponds to rolling direction). Using the same weld parameters and sheet dimensions as the continuous lap weld panel, stitch lap laser beam weld panels were then produced. The stitch welds were 25 mm in length with 20 mm spacing between welds. Tensile shear specimens were water-jet cut from both the continuous and the stitch welded lap joint panels. Cross tension specimens were also welded with a weld length of 25 mm. The weld seam was oriented so that the top of the weld bead was parallel to the length of the top sheet. The gap between the sheets was 0.1 mm.

Full weld penetration was obtained on all of the tensile shear laser beam weld specimens, and cross tension laser beam weld specimens taken from the presently disclosed cold rolled, hot dip galvanized, ultra-high strength, multiphase or complex metallographic structured steel. Visual inspection on all of these welded specimens revealed no pores, no surface cracks, no splash or spatter and no undercut. Thus, it has been demonstrated that the presently claimed multiphase steel sheet is more weldable than commercially available steel sheets of similar tensile strength.

Weldability is one parameter used to determine whether a steel may be used in certain applications in the automotive and other industries. Accordingly, the examples set out above illustrate that the compositions and microstructure of steel developed according to the present methods lead to improved weldability, exceeding the weldability of the prior art methods for commercially available cold rolled boron-containing ultra-high strength steel and the past cold rolled and coated steels of a similar strength.

Although the present disclosure has been shown and described in detail with regard to only a few exemplary embodiments of the disclosure, it should be understood by those skilled in the art that it is not intended to limit the disclosure to specific embodiments disclosed. Various modifications, omissions, and additions may be made to the disclosed embodiments without materially departing from the novel teachings and advantages of the disclosure, particularly in light of the foregoing teachings. Accordingly, it is intended to cover all such modifications, omissions, additions, and equivalents as may be included within the scope of the invention as defined by the following claims.

The invention claimed is:

1. A method of making a complex metallographic structured cold rolled steel, the method comprising:

a) continuously casting a molten steel into a slab, the molten steel having a composition comprising the following elements by weight:

carbon in a range from 0.02% to 0.2%,
manganese in a range from 1.0% to 3.5%,
phosphorous less than or equal to 0.1%,
silicon less than or equal to 1.2%,
aluminum in a range from 0.01% to less than 0.10%,
nitrogen less than or equal to 0.02%,
copper less than or equal to 0.5%,
vanadium less than or equal to 0.12%,
the composition having no purposeful addition of boron, and the balance of the composition comprising iron and incidental ingredients;

b) hot rolling the steel slab to form a sheet, wherein the steel sheet has a finishing exit temperature in a range between (Ar3-30) ° C. and 1000° C. (1832° F.);

c) cooling the sheet or the band at a mean cooling rate of at least 3° C./s (5.4° F./s) with coiling of the sheet or the band at a temperature between 425° C. and 825° C. and subsequently, optionally pickling; and d) cold rolling the sheet or the band to a total cold thickness reduction in a range between greater than 30% and 70%;

e) galvanizing and galvannealing a metal alloy coating on the sheet or the band by heating the steel sheet of step d) to a temperature in the range between 650° C. and 925° C., holding the steel sheet at the temperature range between 650° C. and 925° C. for between 10 seconds and 10 minutes;

f) cooling the steel sheet to a temperature in the range between 400° C. and 550° C.;

g) providing a galvanized and/or galvannealed cold rolled sheet of steps d) through f) having a multiphase microstructure consisting of, in combination, martensite, bainite, and ferrite, martensite between of 35% and 65% by volume, bainite between of 30% and 45% by volume, the remainder volume being essentially ferrite with essentially no retained austenite and a tensile strength greater than 1000 megapascals.

2. The method of claim 1, wherein the chemical composition comprises:

at least one chemical element chosen from molybdenum, chromium, nickel, and a combination thereof, in a range between about 0.05% and about 3.5%; or, molybdenum (Mo) present with chromium (Cr) satisfying a relationship Mo+Cr greater than or equal to 0.05% and less than or equal to 2.0%; or, nickel (Ni) present with copper (Cu) satisfying a relationship Ni+Cu less than or equal to 0.8%.

3. The method of claim 1, wherein the chemical composition comprises at least one chemical element chosen from titanium, niobium and a combination thereof, in a range between 0.005% and 0.8%.

4. The method of claim 1, wherein the galvannealed metal alloy coating comprises zinc, aluminum, or an alloy of zinc and aluminum, or an alloy of aluminum, zinc, and silicon.

5. An article made by the method of claim 1.

* * * * *